US007169995B2

(12) United States Patent
Lin

(10) Patent No.: US 7,169,995 B2
(45) Date of Patent: Jan. 30, 2007

(54) FULL COLOR LED BASED LIGHTING APPARATUS OPERATED IN SYNCHRONISM WITH MUSIC AND METHOD OF CONTROLLING THE SAME

(75) Inventor: Kaun-Chung Lin, Taipei (TW)

(73) Assignee: Friend Spring Industrial Co., Ltd., Taipei (TW)

( * ) Notice: Subject to any disclaimer, the term of this patent is extended or adjusted under 35 U.S.C. 154(b) by 566 days.

(21) Appl. No.: 10/660,647

(22) Filed: Sep. 12, 2003

(65) Prior Publication Data

US 2004/0061668 A1 Apr. 1, 2004

(51) Int. Cl.

| | |
|---|---|
| ***A63J 17/00*** | (2006.01) |
| ***A63J 5/10*** | (2006.01) |
| ***G10H 1/00*** | (2006.01) |

(52) U.S. Cl. ..... 84/464 R

(58) Field of Classification Search ..... 84/464 R, 84/464 A

See application file for complete search history.

(56) References Cited

U.S. PATENT DOCUMENTS

| | | | | |
|---|---|---|---|---|
| 4,355,348 | A * | 10/1982 | Williams | 362/86 |
| 4,928,568 | A * | 5/1990 | Snavely | 84/464 R |
| 5,070,399 | A * | 12/1991 | Martel | 381/56 |
| 5,402,702 | A * | 4/1995 | Hata | 84/464 R |
| 5,784,096 | A * | 7/1998 | Paist | 348/32 |
| 6,686,529 | B2 * | 2/2004 | Kim | 84/464 R |
| 6,927,331 | B2 * | 8/2005 | Haase | 84/464 R |

* cited by examiner

*Primary Examiner*—Jeffrey W Donels
(74) *Attorney, Agent, or Firm*—Troxell Law Office, PLLC

(57) ABSTRACT

A full color LED based lighting apparatus operated in synchronism with music and method of controlling the same is disclosed. LED color and LED brightness can be controlled by means of high and low frequencies of sound. Thus, lighting can be controlled so as to be in synchronism with music as an event proceeds. The invention can provide more excitement, fun, and entertainment. Also, a plurality of embodiments are carried out by the invention.

21 Claims, 17 Drawing Sheets

FULL COLOR LED BASED LIGHTING APPARATUS OPERATED IN SYNCHRONISM WITH MUSIC AND METHOD OF CONTROLLING THE SAME

BACKGROUND OF THE INVENTION

1. Field of the Invention

The present invention relates to lighting system and more particularly to a full color LED (light-emitting diode) based lighting apparatus operated in synchronism with music and method of controlling the same with improved characteristics.

2. Description of Related Art

A conventional LED lighting system can be installed in a large square, billboard, or any of other appropriate places (e.g., restaurants, large meeting places, pubs, concerts, or the like). Lighting is typically controlled by a lighting engineer who, in often times, cannot provide lighting in synchronism with music. Thus, a desired lighting in synchronism with sound cannot be obtained.

Thus, it is desirable to provide an LED based lighting apparatus operated in synchronism with music capable of operate in synchronism with music in a live event for providing more excitement, fun, and entertainment.

SUMMARY OF THE INVENTION

It is an object of the present invention to provide a full color LED based lighting apparatus operated in synchronism with music and method of controlling the same. By utilizing the present invention, a plurality of advantages are obtained as detailed below.

In a first preferred embodiment, LED color can be controlled by different audio frequencies for carrying out a single loop frequency control full color LED based lighting apparatus operated in synchronism with music.

In a second preferred embodiment, an audio frequency is divided into a high frequency band and a low frequency band in which one frequency band is adapted to control background color of LEDs and the other one is adapted to control foreground color of LEDs for carrying out a double loop frequency control full color LED based lighting apparatus operated in synchronism with music.

In a third preferred embodiment, an audio frequency is divided into a high frequency band, an intermediate frequency band, and a low frequency band for controlling blue, red, and green color LEDs respectively so as to carry out a triple loop frequency control full color LED based lighting apparatus operated in synchronism with music.

In a fourth preferred embodiment, LED color is controlled by changing a loop frequency and LED brightness is controlled by changing a loop amplitude for carrying out a single loop frequency and single loop amplitude control full color LED based lighting apparatus operated in synchronism with music.

In a fifth preferred embodiment, an audio frequency is divided into a high frequency band and a low frequency band in which one frequency band is adapted to control background color of LEDs, the other one is adapted to control foreground color of LEDs, and a whole LED brightness is controlled by a loop amplitude for carrying out a double loop frequency and single loop amplitude control full color LED based lighting apparatus operated in synchronism with music.

In a sixth preferred embodiment, an audio frequency is divided into a high frequency band and a low frequency band in which one frequency band is adapted to control background color of LEDs, the other one is adapted to control foreground color of LEDs, and loop brightness is controlled by a loop amplitude for carrying out a double loop frequency and double loop amplitude control full color LED based lighting apparatus operated in synchronism with music.

In a seventh preferred embodiment, an audio frequency is divided into a high frequency band, an intermediate frequency band, and a low frequency band for controlling blue, red, and green color LEDs respectively, and a whole LED brightness is controlled by loop amplitude so as to carry out a triple loop frequency and single loop amplitude control full color LED based lighting apparatus operated in synchronism with music.

In an eighth preferred embodiment, an audio frequency is divided into a high frequency band, an intermediate frequency band, and a low frequency band for controlling blue, red, and green color LEDs respectively, and loop brightness is controlled by loop amplitude for carrying out a triple loop frequency and triple loop amplitude control full color LED based lighting apparatus operated in synchronism with music.

The above and other objects, features and advantages of the present invention will become apparent from the following detailed description taken with the accompanying drawings.

DETAILED DESCRIPTION OF THE PREFERRED EMBODIMENTS

Figure 1:
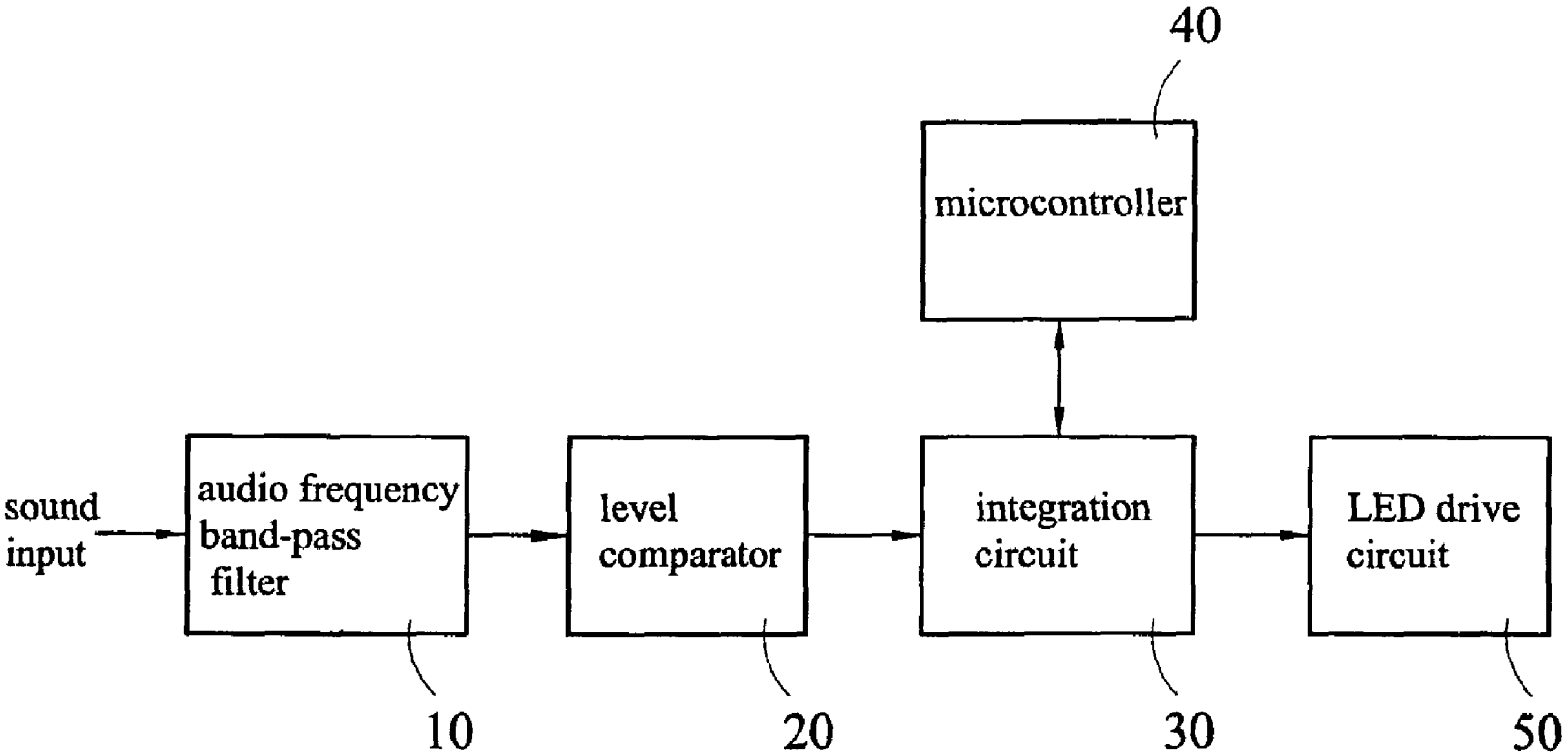
FIG. 1 is a block diagram of a first preferred embodiment of LED based lighting apparatus operated in synchronism with music according to the invention.

Referring to FIG. 1, there is shown an LED based lighting apparatus operated in synchronism with music constructed in accordance with a first preferred embodiment of the invention. The apparatus comprises an audio frequency band-pass filter 10, a level comparator 20, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the level comparator 20. The level comparator 20 is adapted to further amplify the sound signals and convert amplified signals having a voltage higher than a reference voltage into square-wave signals prior to inputting to the integration circuit 30 for frequency calculation. The microcontroller 40 comprises a CPU (central processing unit), a RAM (random access memory), and a ROM (read only memory) having a firmware for controlling the CPU. The integration circuit 30 is adapted to process the square-wave signals fed from the level comparator 20 for obtaining a corresponding frequency which is in turn stored in a register. The CPU is adapted to read out the frequency from the register. Also, the integration circuit 30 is adapted to process input/output (I/O) and scan signals sent from the CPU, and send the processed signals to the LED drive circuit 50 for controlling LED color. This forms a single loop frequency control full color LED based lighting apparatus operated in synchronism with music.

Figure 2:
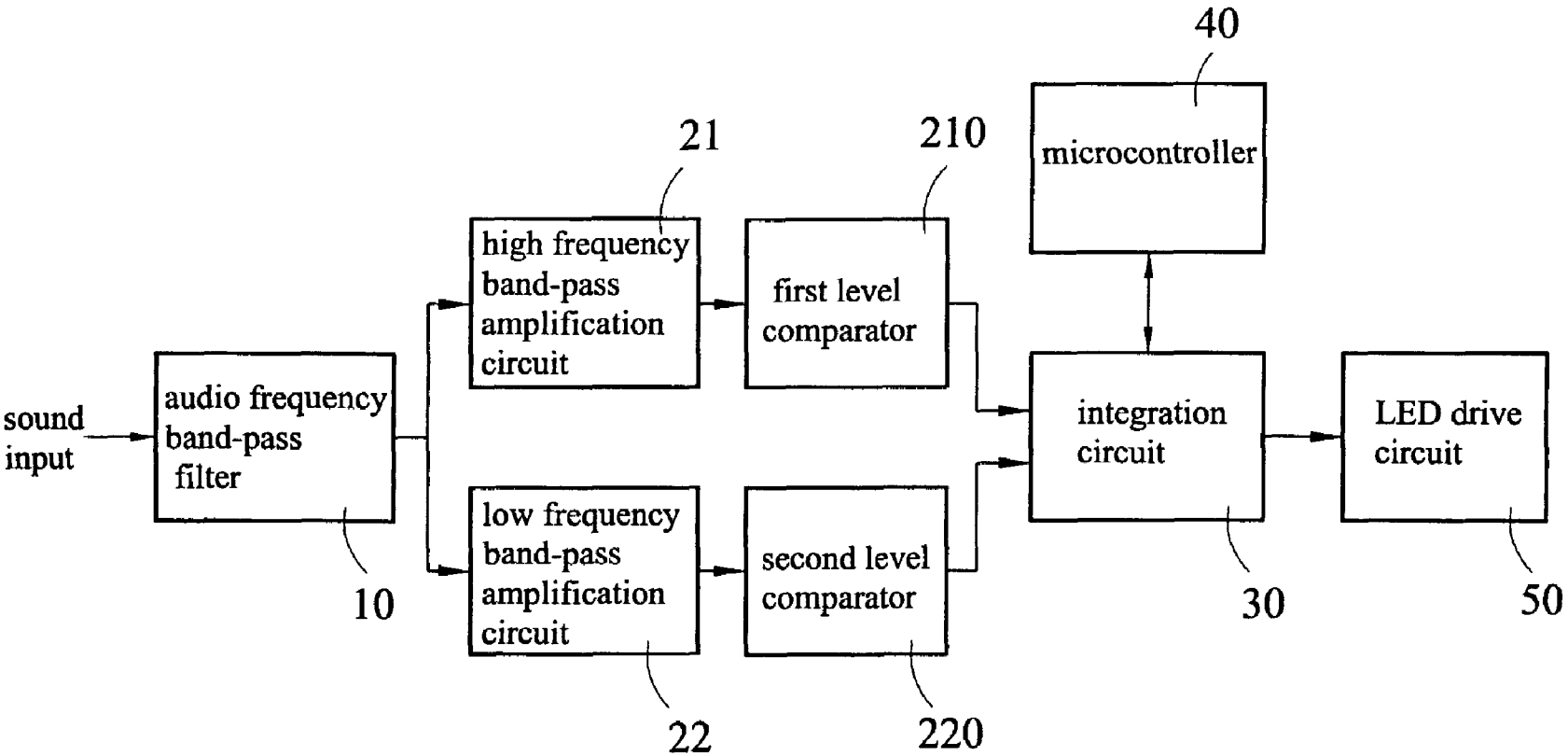
FIG. 2 is a block diagram of a second preferred embodiment of LED based lighting apparatus operated in synchronism with music according to the invention.

Referring to FIG. 2, there is shown an LED based lighting apparatus operated in synchronism with music constructed in accordance with a second preferred embodiment of the invention. The apparatus is characterized in that audio frequency is divided into a high frequency band and a low frequency band in which one of the frequency bands is adapted to control background color of LEDs and the other one is adapted to control foreground color of LEDs. Alternatively, one of the frequency bands is adapted to control foreground color of LEDs and the other one is adapted to control background color of LEDs. The apparatus comprises an audio frequency band-pass filter 10, a high frequency band-pass amplification circuit 21, a low frequency band-pass amplification circuit 22, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the high frequency band-pass amplification circuit 21 and the low frequency band-pass amplification circuit 22 respectively. The high frequency band-pass amplification circuit 21 comprises a first level comparator 210. The high frequency band-pass amplification circuit 21 and the first level comparator 210 together form a first detection loop of high frequency band. The first detection loop of high frequency band is adapted to further amplify signals having a high frequency band and convert the amplified signals having a voltage higher than the reference voltage into square-wave signals prior to inputting to the integration circuit 30 for frequency calculation. The low frequency band-pass amplification circuit 22 comprises a second level comparator 220. The high frequency band-pass amplification circuit 21 and the second level comparator 220 together form a second detection loop of low frequency band. The second detection loop of low frequency band is adapted to further amplify signals having a low frequency band and convert the amplified signals having a voltage higher than the reference voltage into square-wave signals prior to inputting to the integration circuit 30 for frequency calculation. The microcontroller 40 comprises a CPU, a RAM, and a ROM having a firmware for controlling the CPU. The integration circuit 30 is adapted to process the square-wave signals fed from the first level comparator 210 for obtaining a corresponding frequency in response to input from the first detection loop. The corresponding frequency is stored in a register. The CPU is adapted to read out the frequency from the register. Also, the integration circuit 30 is adapted to process I/O and scan signals sent from the CPU, and send the processed signals to the LED drive circuit 50 for controlling background color of LEDs. The integration circuit 30 is also adapted to process the square-wave signals fed from the second level comparator 220 for obtaining a corresponding frequency in response to input from the second detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling foreground color of LEDs. This forms a double loop frequency control full color LED based lighting apparatus operated in synchronism with music.

Figure 3:
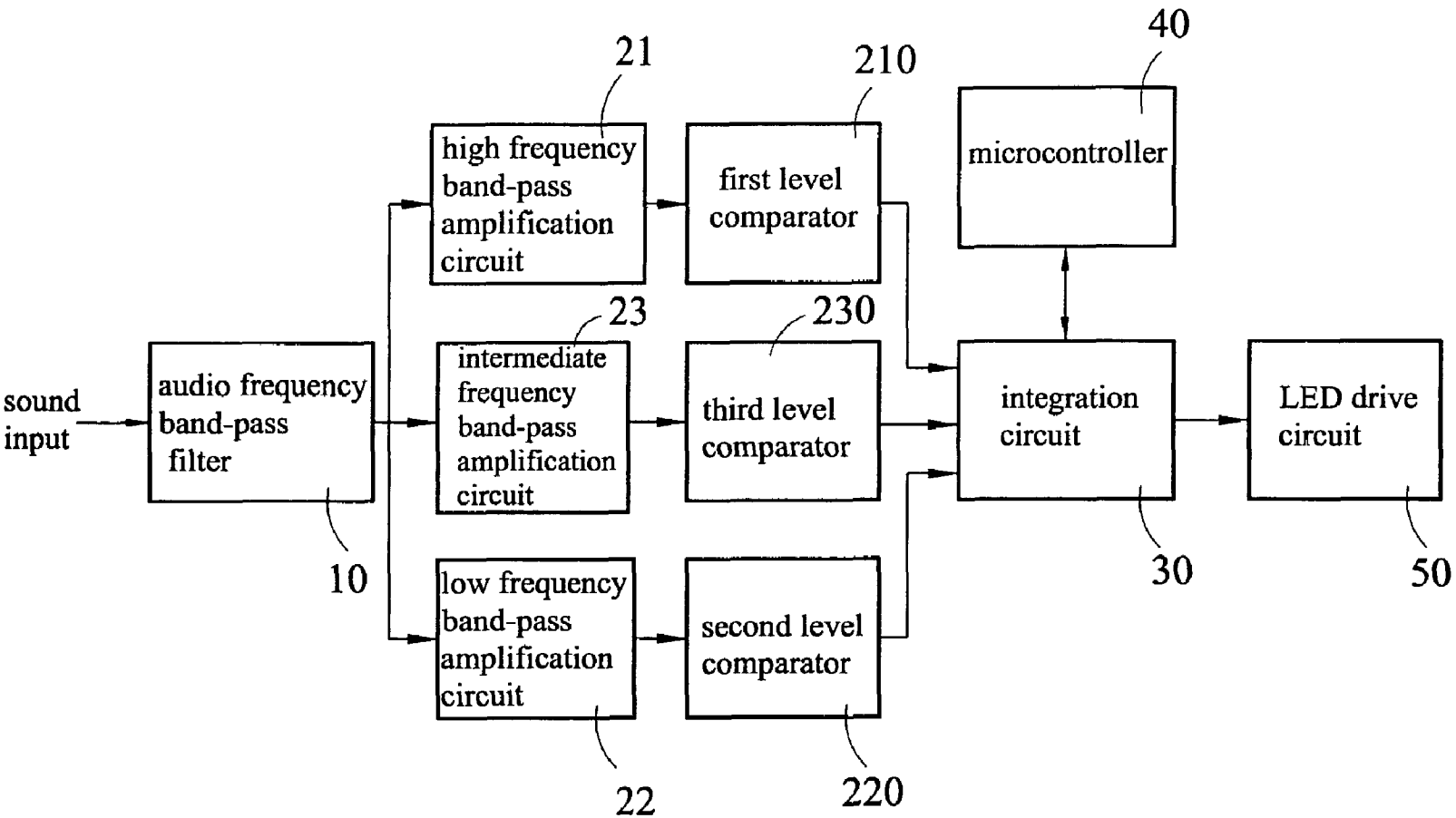
FIG. 3 is a block diagram of a third preferred embodiment of LED based lighting apparatus operated in synchronism with music according to the invention.

Referring to FIG. 3, there is shown an LED based lighting apparatus operated in synchronism with music constructed in accordance with a third preferred embodiment of the invention. The apparatus is characterized in that audio frequency is divided into a high frequency band, an intermediate frequency band, and a low frequency band for controlling blue, red, and green color LEDs respectively. The apparatus comprises an audio frequency band-pass filter 10, a high frequency band-pass amplification circuit 21, a low frequency band-pass amplification circuit 22, an intermediate frequency band-pass amplification circuit 23, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the high frequency band-pass amplification circuit 21, the low frequency band-pass amplification circuit 22, and the intermediate frequency band-pass amplification circuit 23 respectively. The high frequency band-pass amplification circuit 21 comprises a first level comparator 210. The high frequency band-pass amplification circuit 21 and the first level comparator 210 together form a first detection loop of high frequency band. The first detection loop of high frequency band is adapted to further amplify signals having a high frequency band and convert the amplified signals having a voltage higher than the reference voltage into square-wave signals prior to inputting to the integration circuit 30 for frequency calculation. The low frequency band-pass amplification circuit 22 comprises a second level comparator 220. The low frequency band-pass amplification circuit 22 and the second level comparator 220 together form a second detection loop of low frequency band. The second detection loop of low frequency band is adapted to further amplify signals having a low frequency band and convert the amplified signals having a voltage higher than the reference voltage into square-wave signals prior to inputting to the integration circuit 30 for frequency calculation. The intermediate frequency band-pass amplification circuit 23 comprises a third level comparator 230. The intermediate frequency band-pass amplification circuit 23 and the third level comparator 230 together form a third detection loop of intermediate frequency band. The third detection loop of intermediate frequency band is adapted to further amplify signals having an intermediate frequency band and convert the amplified signals having a voltage higher than the reference voltage into square-wave signals prior to inputting to the integration circuit 30 for frequency calculation. The microcontroller 40 comprises a CPU, a RAM, and a ROM having a firmware for controlling the CPU. The integration circuit 30 is adapted to process the square-wave signals fed from the first level comparator 210 for obtaining a corresponding frequency in response to input from the first detection loop. The corresponding frequency is stored in a register. The CPU is adapted to read out the frequency from the register. Also, the integration circuit 30 is adapted to process I/O and scan signals sent from the CPU, and send the processed signals to the LED drive circuit 50 for controlling blue LEDs. The integration circuit 30 is also adapted to process the square-wave signals fed from the second level comparator 220 for obtaining a corresponding frequency in response to input from the second detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling red LEDs. The integration circuit 30 is also adapted to process the square-wave signals fed from the third level comparator 230 for obtaining a corresponding frequency in response to input from the third detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling green LEDs. This forms a triple loop frequency control full color LED based lighting apparatus operated in synchronism with music.

Figure 4:
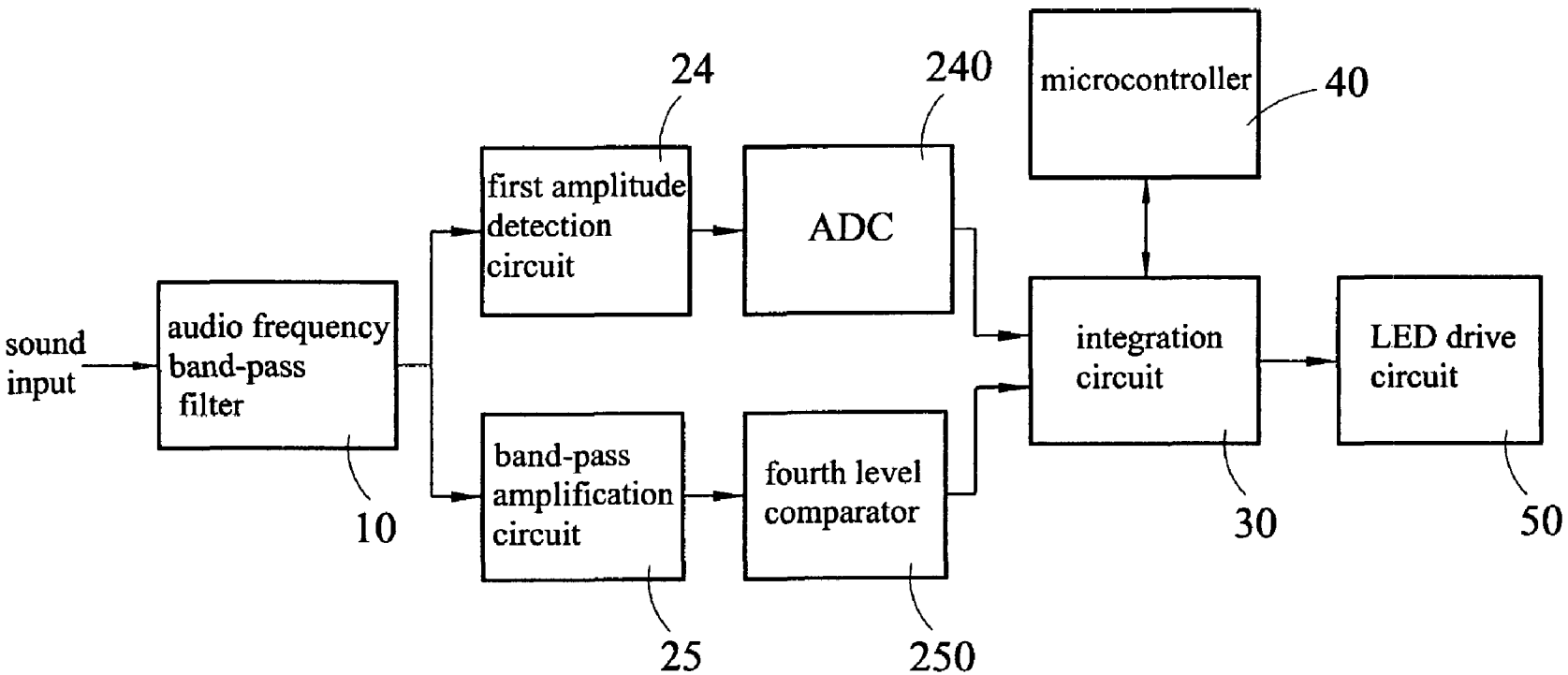
FIG. 4 is a block diagram of a fourth preferred embodiment of LED based lighting apparatus operated in synchronism with music according to the invention.

Referring to FIG. 4, there is shown an LED based lighting apparatus operated in synchronism with music constructed in accordance with a fourth preferred embodiment of the invention. The apparatus is characterized in that LED color is controlled by changing loop frequency and LED brightness is controlled by changing loop amplitude. The apparatus comprises an audio frequency band-pass filter 10, a first amplitude detection circuit 24, a band-pass amplification circuit 25, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the first amplitude detection circuit 24 and the band-pass amplification circuit 25 respectively. The first amplitude detection circuit 24 comprises an ADC (analog-to-digital converter) 240. The first amplitude detection circuit 24 and the ADC 240 together form an amplitude detection loop. The amplitude detection loop is adapted to obtain peaks of signals and convert the peaks of signals into digital amplitudes of signals by means of the ADC 240 prior to inputting to the integration circuit 30 for reading. The band-pass amplification circuit 25 comprises a fourth level comparator 250. The band-pass amplification circuit 25 and the fourth level comparator 250 together form a frequency detection loop. The frequency detection loop is adapted to further amplify signals and convert the amplified signals having a voltage higher than the reference voltage into square-wave signals prior to inputting to the integration circuit 30 for frequency calculation. The microcontroller 40 comprises a CPU, a RAM, and a ROM having a firmware for controlling the CPU. The integration circuit 30 is adapted to store the amplitudes of signals in a register in response to input from the ADC 240. The CPU is adapted to read out the amplitudes of signals fed from the register. Also, the integration circuit 30 is adapted to process I/O and scan signals sent from the CPU, and send the processed signals to the LED drive circuit 50 for controlling LED brightness. The integration circuit 30 is adapted to store the square-wave signals in the register in response to input from the fourth level comparator 250. The CPU is adapted to read out the square-wave signals from the register. Also, the integration circuit 30 is adapted to process I/O and scan signals sent from the CPU, and send the processed signals to the LED drive circuit 50 for controlling LED color. This forms a single loop frequency and single loop amplitude control full color LED based lighting apparatus operated in synchronism with music.

Figure 5:
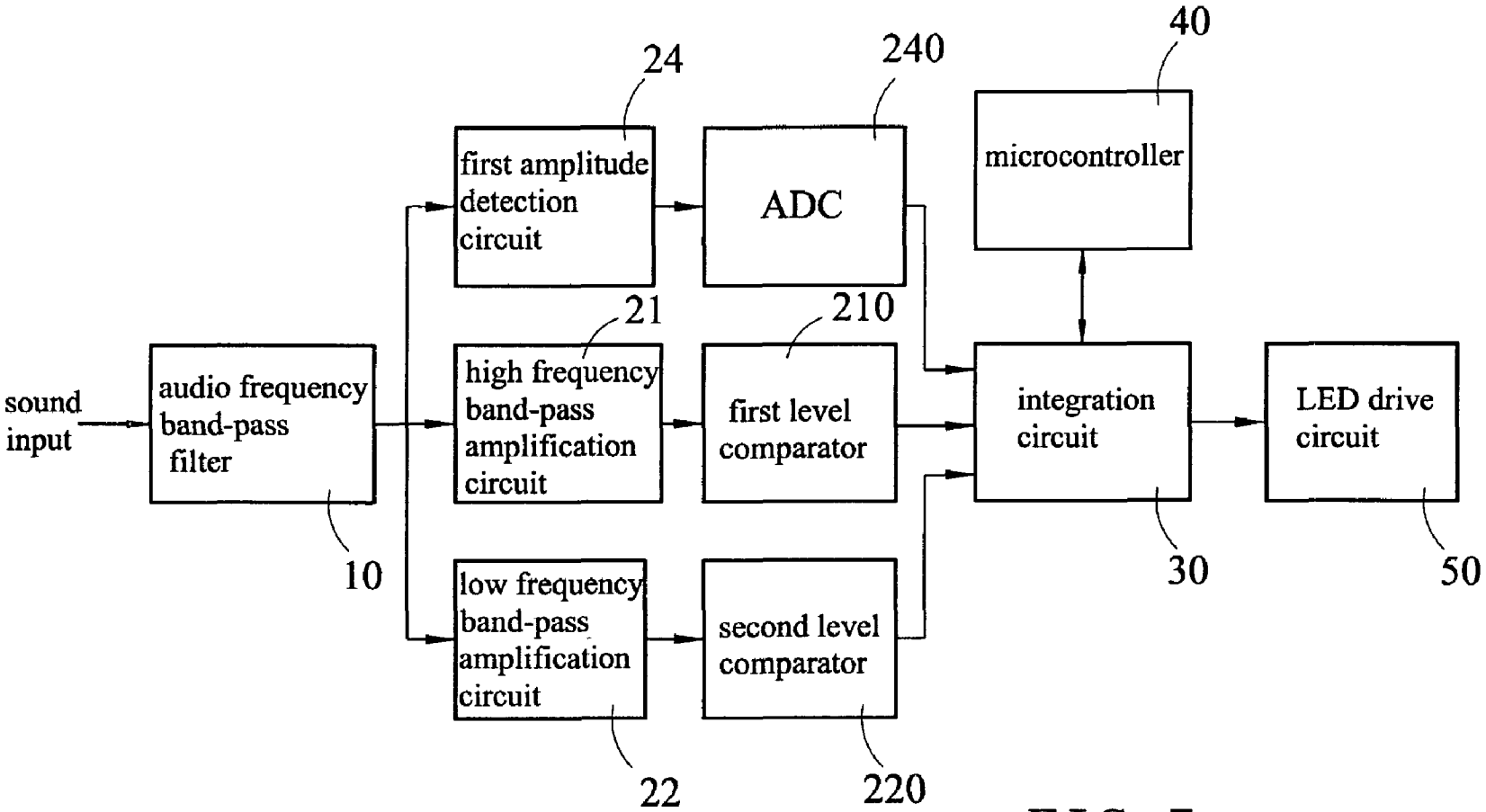
FIG. 5 is a block diagram of a fifth preferred embodiment of LED based lighting apparatus operated in synchronism with music according to the invention.

Referring to FIG. 5, there is shown an LED based lighting apparatus operated in synchronism with music constructed in accordance with a fifth preferred embodiment of the invention. The apparatus is characterized in that audio frequency is divided into a high frequency band and a low frequency band in which one of the frequency bands is adapted to control background color of LEDs and the other one is adapted to control foreground color of LEDs. Alternatively, one of the frequency bands is adapted to control foreground color of LEDs and the other one is adapted to control background color of LEDs. Further, a whole LED brightness is controlled by loop amplitude. The apparatus comprises an audio frequency band-pass filter 10, a high frequency band-pass amplification circuit 21, a low frequency band-pass amplification circuit 22, a first amplitude detection circuit 24, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the high frequency band-pass amplification circuit 21, the low frequency band-pass amplification circuit 22, and the first amplitude detection circuit 24 respectively. The high frequency band-pass amplification circuit 21 comprises a first level comparator 210. The high frequency band-pass amplification circuit 21 and the first level comparator 210 together form a first detection loop of high frequency band. The first detection loop of high frequency band is adapted to further amplify signals having a high frequency band and convert the amplified signals having a voltage higher than the reference voltage into square-wave signals prior to inputting to the integration circuit 30 for frequency calculation. The low frequency band-pass amplification circuit 22 comprises a second level comparator 220. The low frequency band-pass amplification circuit 22 and the second level comparator 220 together form a second detection loop of low frequency band. The second detection loop of low frequency band is adapted to further amplify signals having a low frequency band and convert the amplified signals having a voltage higher than the reference voltage into square-wave signals prior to inputting to the integration circuit 30 for frequency calculation. The first amplitude detection circuit 24 comprises an ADC 240. The first amplitude detection circuit 24 and the ADC 240 together form an amplitude detection loop. The amplitude detection loop is adapted to obtain peaks of signals and convert the peaks of signals into digital amplitudes of signals by means of the ADC 240 prior to inputting to the integration circuit 30 for reading. The microcontroller 40 comprises a CPU, a RAM, and a ROM having a firmware for controlling the CPU. The integration circuit 30 is adapted to process the square-wave signals fed from the first level comparator 210 for obtaining a corresponding frequency in response to input from the first detection loop. The corresponding frequency is stored in a register. The CPU is adapted to read out the frequency from the register. Also, the integration circuit 30 is adapted to process I/O and scan signals sent from the CPU, and send the processed signals to the LED drive circuit 50 for controlling background color of LEDs. The integration circuit 30 is also adapted to process the square-wave signals fed from the second level comparator 220 for obtaining a corresponding frequency in response to input from the second detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling foreground color of LEDs. The integration circuit 30 is further adapted to store the amplitudes of signals in the register in response to input from the ADC 240. The CPU is adapted to read out the amplitudes of signals fed from the register. Also, the integration circuit 30 is adapted to process I/O and scan signals sent from the CPU, and send the processed signals to the LED drive circuit 50 for controlling a whole LED brightness. This forms a double loop frequency and single loop amplitude control full color LED based lighting apparatus operated in synchronism with music.

Figure 6:
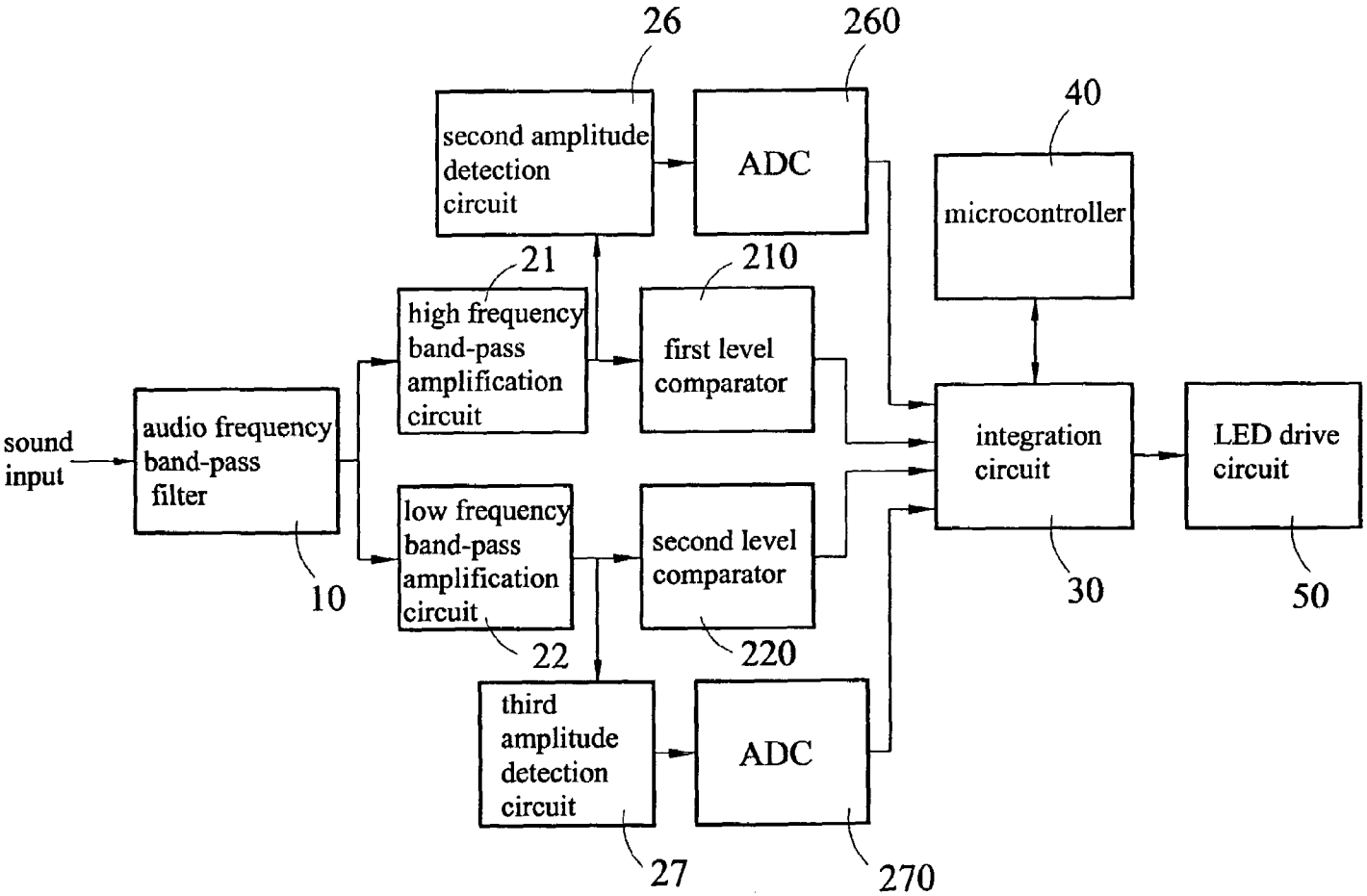
FIG. 6 is a block diagram of a sixth preferred embodiment of LED based lighting apparatus operated in synchronism with music according to the invention.

Referring to FIG. 6, there is shown an LED based lighting apparatus operated in synchronism with music constructed in accordance with a sixth preferred embodiment of the invention. The apparatus is characterized in that audio frequency is divided into a high frequency band and a low frequency band in which one of the frequency bands is adapted to control background color of LEDs and the other one is adapted to control foreground color of LEDs. Alternatively, one of the frequency bands is adapted to control foreground color of LEDs and the other one is adapted to control background color of LEDd. Further, loop brightness is controlled by loop amplitude. The apparatus comprises an audio frequency band-pass filter 10, a high frequency band-pass amplification circuit 21, a low frequency band-pass amplification circuit 22, a second amplitude detection circuit 26, a third amplitude detection circuit 27, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the high frequency band-pass amplification circuit 21 and the low frequency band-pass amplification circuit 22 respectively. The high frequency band-pass amplification circuit 21 comprises a first level comparator 210. The high frequency band-pass amplification circuit 21 and the first level comparator 210 together form a first detection loop of high frequency band. The first detection loop of high frequency band is adapted to further amplify signals having a high frequency band and convert the amplified signals having a voltage higher than the reference voltage into square-wave signals prior to inputting to the integration circuit 30 for frequency calculation. The low frequency band-pass amplification circuit 22 comprises a second level comparator 220. The low frequency band-pass amplification circuit 22 and the second level comparator 220 together form a second detection loop of low frequency band. The second detection loop of low frequency band is adapted to further amplify signals having a low frequency band and convert the amplified signals having a voltage higher than the reference voltage into square-wave signals prior to inputting to the integration circuit 30 for frequency calculation. The second amplitude detection circuit 26 comprises an ADC 260. The second amplitude detection circuit 26 and the ADC 260 together form a detection loop of high frequency amplitude. The detection loop of high frequency amplitude is adapted to obtain peaks of signals having a high frequency and convert the peaks of signals into digital high frequency amplitudes of signals by means of the ADC 260 prior to inputting to the integration circuit 30 for reading. The third amplitude detection circuit 27 comprises an ADC 270. The third amplitude detection circuit 27 and the ADC 270 together form a detection loop of low frequency amplitude. The detection loop of low frequency amplitude is adapted to obtain peaks of signals having a low frequency and convert the peaks of signals into digital low frequency amplitudes of signals by means of the ADC 270 prior to inputting to the integration circuit 30 for reading. The microcontroller 40 comprises a CPU, a RAM, and a ROM having a firmware for controlling the CPU. The integration circuit 30 is adapted to process the square-wave signals fed from the first level comparator 210 for obtaining a corresponding frequency in response to input from the first detection loop. The corresponding frequency is stored in a register. The CPU is adapted to read out the frequency from the register. Also, the integration circuit 30 is adapted to process I/O and scan signals sent from the CPU, and send the processed signals to the LED drive circuit 50 for controlling background color of LEDs. The integration circuit 30 is also adapted to process the square-wave signals fed from the second level comparator 220 for obtaining a corresponding frequency in response to input from the second detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling foreground color of LEDs. The integration circuit 30 is further adapted to store the high frequency amplitudes in the register in response to input from the ADC 260. The CPU is adapted to read out the high frequency amplitudes from the register. Also, the integration circuit 30 is adapted to process I/O and scan signals sent from the CPU, and send the processed signals to the LED drive circuit 50 for controlling brightness of the first detection loop. The integration circuit 30 is further adapted to store the low frequency amplitudes in the register in response to input from the ADC 270. The CPU is adapted to read out the low frequency amplitudes from the register. Also, the integration circuit 30 is adapted to process I/O and scan signals sent from the CPU, and send the processed signals to the LED drive circuit 50 for controlling brightness of the second detection loop. This forms a double loop frequency and double loop amplitude control full color LED based lighting apparatus operated in synchronism with music.

Figure 7:
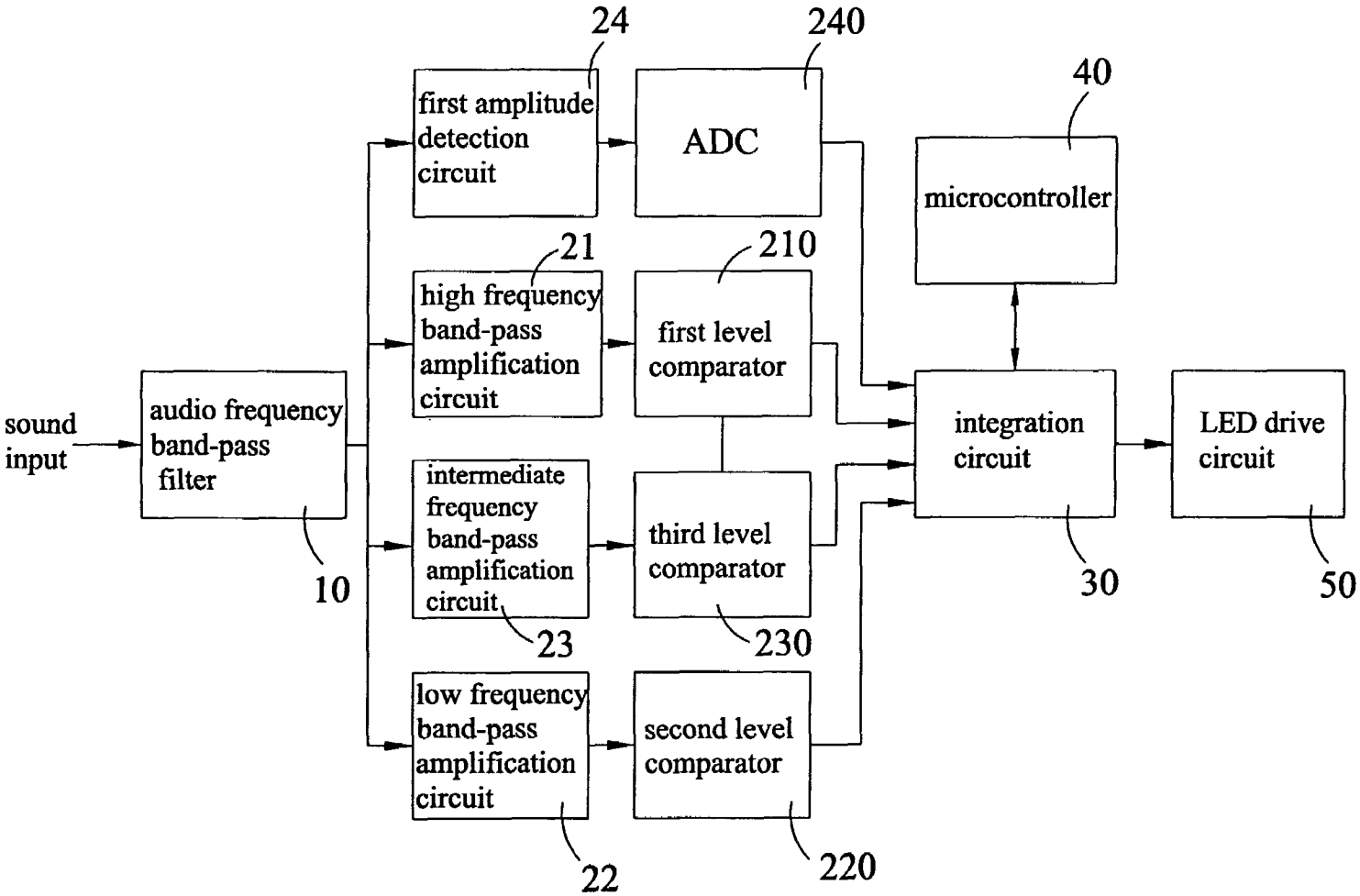
FIG. 7 is a block diagram of a seventh preferred embodiment of LED based lighting apparatus operated in synchronism with music according to the invention.

Referring to FIG. 7, there is shown an LED based lighting apparatus operated in synchronism with music constructed in accordance with a seventh preferred embodiment of the invention. The apparatus is characterized in that audio frequency is divided into a high frequency band, an intermediate frequency band, and a low frequency band for controlling blue, red, and green color LEDs respectively. Further, a whole LED brightness is controlled by loop amplitude. The apparatus comprises an audio frequency band-pass filter 10, a high frequency band-pass amplification circuit 21, a low frequency band-pass amplification circuit 22, an intermediate frequency band-pass amplification circuit 23, a first amplitude detection circuit 24, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the high frequency band-pass amplification circuit 21, the low frequency band-pass amplification circuit 22, and the intermediate frequency band-pass amplification circuit 23 respectively. The high frequency band-pass amplification circuit 21 comprises a first level comparator 210. The high frequency band-pass amplification circuit 21 and the first level comparator 210 together form a first detection loop of high frequency band. The first detection loop of high frequency band is adapted to further amplify signals having a high frequency band and convert the amplified signals having a voltage higher than the reference voltage into square-wave signals prior to inputting to the integration circuit 30 for frequency calculation. The low frequency band-pass amplification circuit 22 comprises a second level comparator 220. The low frequency band-pass amplification circuit 22 and the second level comparator 220 together form a second detection loop of low frequency band. The second detection loop of low frequency band is adapted to further amplify signals having a low frequency band and convert the amplified signals having a voltage higher than the reference voltage into square-wave signals prior to inputting to the integration circuit 30 for frequency calculation. The intermediate frequency band-pass amplification circuit 23 comprises a third level comparator 230. The intermediate frequency band-pass amplification circuit 23 and the third level comparator 230 together form a third detection loop of intermediate frequency band. The second detection loop of intermediate frequency band is adapted to further amplify signals having an intermediate frequency band and convert the amplified signals having a voltage higher than the reference voltage into square-wave signals prior to inputting to the integration circuit 30 for frequency calculation. The first amplitude detection circuit 24 comprises an ADC 240. The first amplitude detection circuit 24 and the ADC 240 together form an amplitude detection loop. The amplitude detection loop is adapted to obtain peaks of signals and convert the peaks of signals into digital amplitudes of signals by means of the ADC 240 prior to inputting to the integration circuit 30 for reading. The microcontroller 40 comprises a CPU, a RAM, and a ROM having a firmware for controlling the CPU. The integration circuit 30 is adapted to process the square-wave signals fed from the first level comparator 210 for obtaining a corresponding frequency in response to input from the first detection loop. The corresponding frequency is stored in a register. The CPU is adapted to read out the frequency from the register. Also, the integration circuit 30 is adapted to process I/O and scan signals sent from the CPU, and send the processed signals to the LED drive circuit 50 for controlling blue LEDs. The integration circuit 30 is also adapted to process the square-wave signals fed from the second level comparator 220 for obtaining a corresponding frequency in response to input from the second detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling red LEDs. The integration circuit 30 is also adapted to process the square-wave signals fed from the third level comparator 230 for obtaining a corresponding frequency in response to input from the third detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling green LEDs. The integration circuit 30 is adapted to store the amplitudes of signals in the register in response to input from the ADC 240. The CPU is adapted to read out the amplitudes of signals fed from the register. Also, the integration circuit 30 is adapted to process I/O and scan signals sent from the CPU, and send the processed signals to the LED drive circuit 50 for controlling a whole LED brightness. This forms a triple loop frequency and single loop amplitude control full color LED based lighting apparatus operated in synchronism with music.

Figure 8:
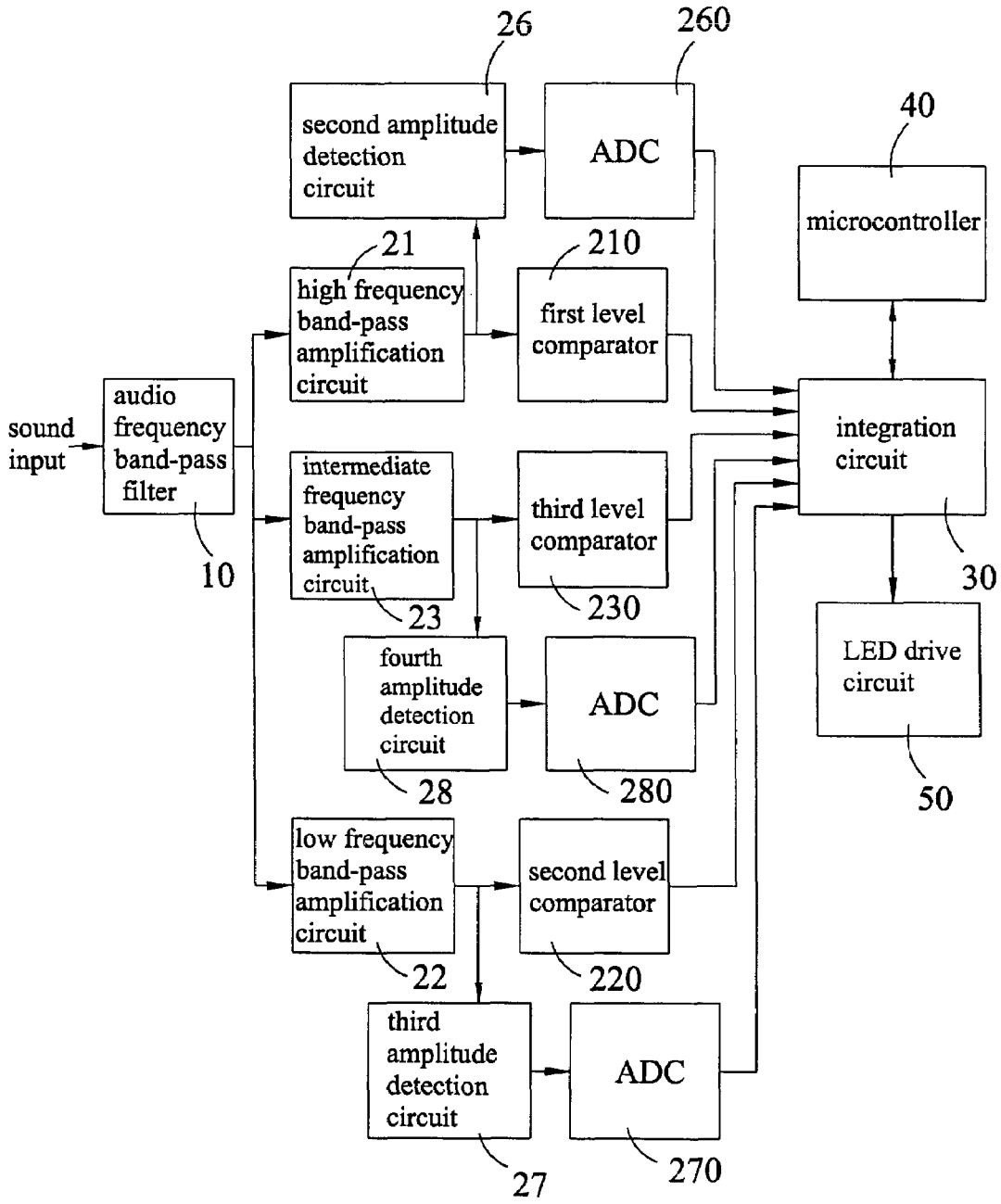
FIG. 8 is a block diagram of an eighth preferred embodiment of LED based lighting apparatus operated in synchronism with music according to the invention.

Referring to FIG. 8, there is shown an LED based lighting apparatus operated in synchronism with music constructed in accordance with an eighth preferred embodiment of the invention. The apparatus is characterized in that audio frequency is divided into a high frequency band, an intermediate frequency band, and a low frequency band for controlling blue, red, and green color LEDs respectively. Further, loop brightness is controlled by loop amplitude. The apparatus comprises an audio frequency band-pass filter 10, a high frequency band-pass amplification circuit 21, a low frequency band-pass amplification circuit 22, an intermediate frequency band-pass amplification circuit 23, a second amplitude detection circuit 26, a third amplitude detection circuit 27, a fourth amplitude detection circuit 28, an integration circuit 30, a microcontroller 40, and an LED drive circuit 50. Each component will be described in detail below.

The audio frequency band-pass filter 10 is adapted to filter out signals other than sound source in sound input for obtaining sound signals. Also, the audio frequency band-pass filter 10 is adapted to amplify the sound signals prior to inputting to the high frequency band-pass amplification circuit 21, the low frequency band-pass amplification circuit 22, and the intermediate frequency band-pass amplification circuit 23 respectively. The high frequency band-pass amplification circuit 21 comprises a first level comparator 210. The high frequency band-pass amplification circuit 21 and the first level comparator 210 together form a first detection loop of high frequency band. The first detection loop of high frequency band is adapted to further amplify signals having a high frequency band and convert the amplified signals having a voltage higher than the reference voltage into square-wave signals prior to inputting to the integration circuit 30 for frequency calculation. The low frequency band-pass amplification circuit 22 comprises a second level comparator 220. The low frequency band-pass amplification circuit 22 and the second level comparator 220 together form a second detection loop of low frequency band. The second detection loop of low frequency band is adapted to further amplify signals having a low frequency band and convert the amplified signals having a voltage higher than the reference voltage into square-wave signals prior to inputting to the integration circuit 30 for frequency calculation. The intermediate frequency band-pass amplification circuit 23 comprises a third level comparator 230. The intermediate frequency band-pass amplification circuit 23 and the third level comparator 230 together form a third detection loop of intermediate frequency band. The third detection loop of intermediate frequency band is adapted to further amplify signals having an intermediate frequency band and convert the amplified signals having a voltage higher than the reference voltage into square-wave signals prior to inputting to the integration circuit 30 for frequency calculation. The second amplitude detection circuit 26 comprises an ADC 260. The second amplitude detection circuit 26 and the ADC 260 together form a detection loop of high frequency amplitude. The detection loop of high frequency amplitude is adapted to obtain peaks of signals having a high frequency and convert the peaks of signals into digital high frequency amplitudes of signals by means of the ADC 260 prior to inputting to the integration circuit 30 for reading. The third amplitude detection circuit 27 comprises an ADC 270. The third amplitude detection circuit 27 and the ADC 270 together form a detection loop of low frequency amplitude. The detection loop of low frequency amplitude is adapted to obtain peaks of signals having a low frequency and convert the peaks of signals into digital low frequency amplitudes of signals by means of the ADC 270 prior to inputting to the integration circuit 30 for reading. The fourth amplitude detection circuit 28 comprises an ADC 280. The fourth amplitude detection circuit 28 and the ADC 280 together form a detection loop of intermediate frequency amplitude. The detection loop of intermediate frequency amplitude is adapted to obtain peaks of signals having an intermediate frequency and convert the peaks of signals into digital intermediate frequency amplitudes of signals by means of the ADC 280 prior to inputting to the integration circuit 30 for reading. The microcontroller 40 comprises a CPU, a RAM, and a ROM having a firmware for controlling the CPU. The integration circuit 30 is adapted to process the square-wave signals fed from the first level comparator 210 for obtaining a corresponding frequency in response to input from the first detection loop. The corresponding frequency is stored in a register. The CPU is adapted to read out the frequency from the register. Also, the integration circuit 30 is adapted to process I/O and scan signals sent from the CPU, and send the processed signals to the LED drive circuit 50 for controlling blue LEDs. The integration circuit 30 is also adapted to process the square-wave signals fed from the second level comparator 220 for obtaining a corresponding frequency in response to input from the second detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling red LEDs. The integration circuit 30 is also adapted to process the square-wave signals fed from the third level comparator 230 for obtaining a corresponding frequency in response to input from the third detection loop. The corresponding frequency is stored in the register. The CPU is adapted to read out the frequency from the register. Also, the integration circuit 30 is adapted to process I/O and scan signals sent from the CPU, and send the processed signals to the LED drive circuit 50 for controlling green LEDs. The integration circuit 30 is adapted to store the high frequency amplitudes of signals in the register in response to input from the ADC 260. The CPU is adapted to read out the high frequency amplitudes of signals fed from the register. Also, the integration circuit 30 is adapted to process I/O and scan signals sent from the CPU, and send the processed signals to the LED drive circuit 50 for controlling brightness of the first detection loop. The integration circuit 30 is adapted to store the low frequency amplitudes of signals in the register in response to input from the ADC 270. The CPU is adapted to read out the low frequency amplitudes of signals fed from the register. Also, the integration circuit 30 is adapted to process I/O and scan signals sent from the CPU, and send the processed signals to the LED drive circuit 50 for controlling brightness of the second detection loop. The integration circuit 30 is adapted to store the intermediate frequency amplitudes of signals in the register in response to input from the ADC 280. The CPU is adapted to read out the intermediate frequency amplitudes of signals fed from the register. Also, the integration circuit 30 is adapted to process I/O and scan signals sent from the CPU, and send the processed signals to the LED drive circuit 50 for controlling brightness of the third detection loop. This forms a triple loop frequency and triple loop amplitude control full color LED based lighting apparatus operated in synchronism with music.

It is noted that in the second and fifth preferred embodiments, frequency obtained by the first detection loop is also adapted to control foreground color of LEDs and frequency obtained by the second detection loop is also adapted to control background color of LEDs. Alternatively, frequency obtained by the first detection loop is adapted to control background color of LEDs and frequency obtained by the second detection loop is adapted to control foreground color of LED. It is further noted that in the third, seventh, and eighth preferred embodiments, frequencies obtained by the first, second, and third detection loops are adapted to control blue, red, and green LEDs respectively, blue, green, and red LEDs respectively, red, blue, and green LEDs respectively, red, green, and blue LEDs respectively, green, blue, and red LEDs respectively, or green, red, and blue LEDs respectively.

Figure 9:
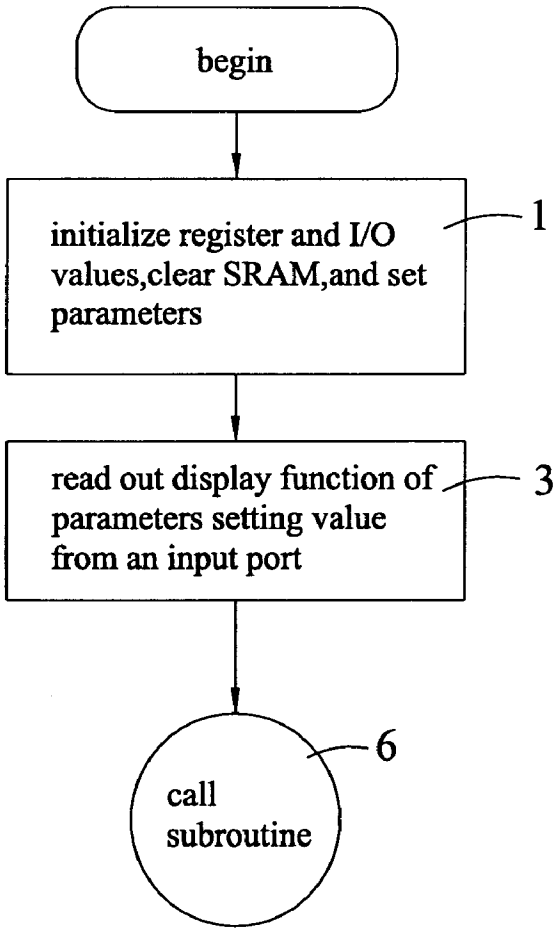
FIG. 9 is a flow chart illustrating a first process according to the invention.

Referring to FIG. 9, there is shown a first process according to the invention. Steps of the first process will now be described in detail below. First, initialize the register and I/O values, clear SRAM (static RAM), and set parameters (step 1). Next, read out display function of parameters setting value from an input port (step 3). Finally, call a subroutine (e.g., interrupt subroutine) as detailed below (step 6).

Figure 10:
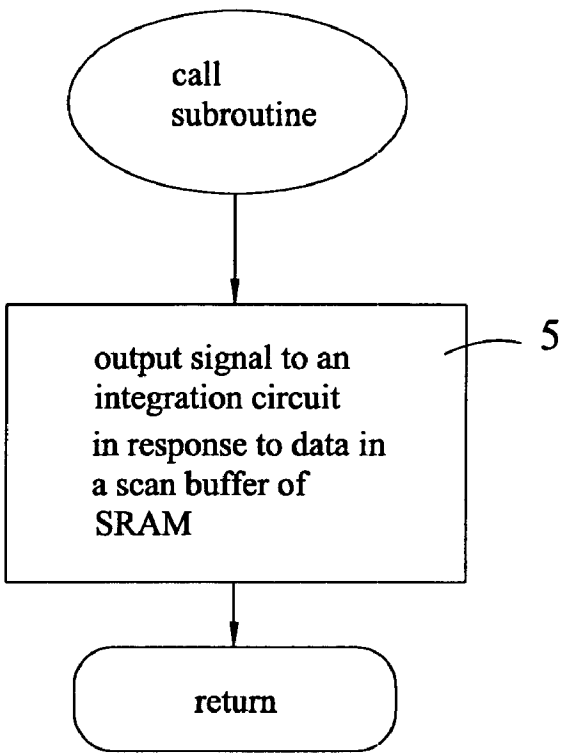
FIG. 10 is a flow chart illustrating a subroutine of the first process illustrated in FIG. 9.

The flow chart of FIG. 10 illustrates a call subroutine of the first process. In step 5, output signal to the integration circuit 30 in response to data in a scan buffer of SRAM. The subroutine returns to the first process immediately.

Figure 11:
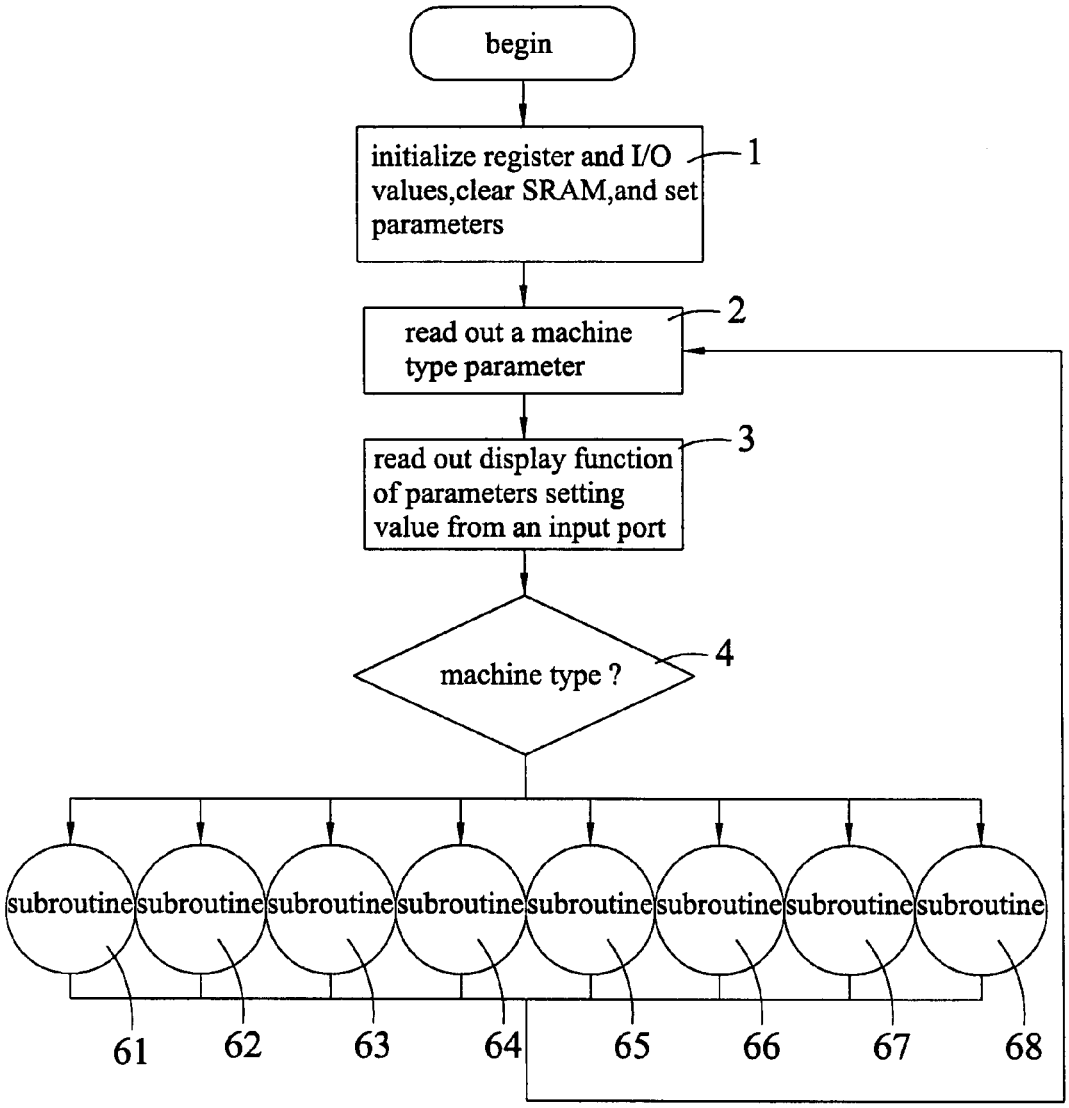
FIG. 11 is a flow chart illustrating a second process according to the invention.

The flow chart of FIG. 11 illustrates a second process according to the invention. Steps of the second process will now be described in detail below. First, initialize the register and I/O values, clear SRAM, and set parameters (step 1). Next, read out a machine type parameter (step 2). Next, read out display function of parameters setting value from the input port (step 3). Next, determine the machine type from the read machine type parameter (step 4). Finally, call one of subroutines 61, 62, 63, 64, 65, 66, 67, and 68 based on the machine type as detailed below.

Figure 12:
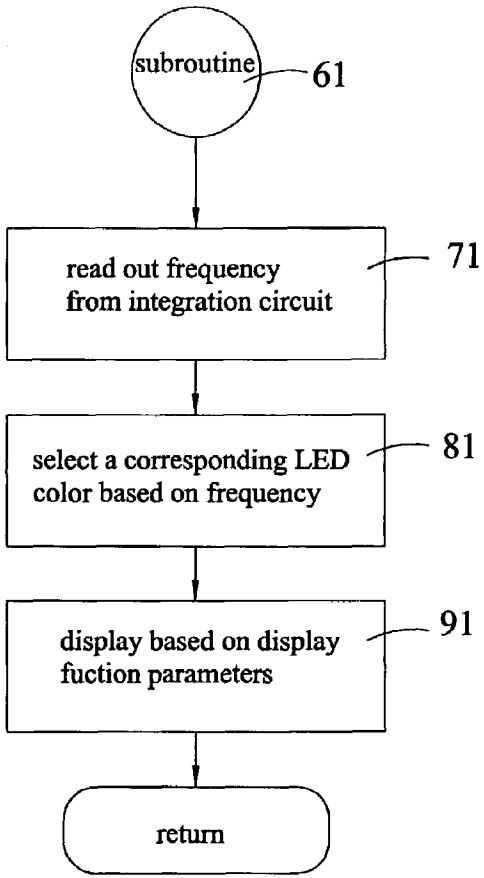

The flow chart of FIG. 12 illustrates the subroutine 61 of the second process with respect to the single loop frequency control. First, read out frequency from the integration circuit 30 (step 71). Next, select a corresponding LED color based on the frequency (step 81). Finally, display based on the display function parameters (step 91) prior to returning to the second process.

Figure 13:
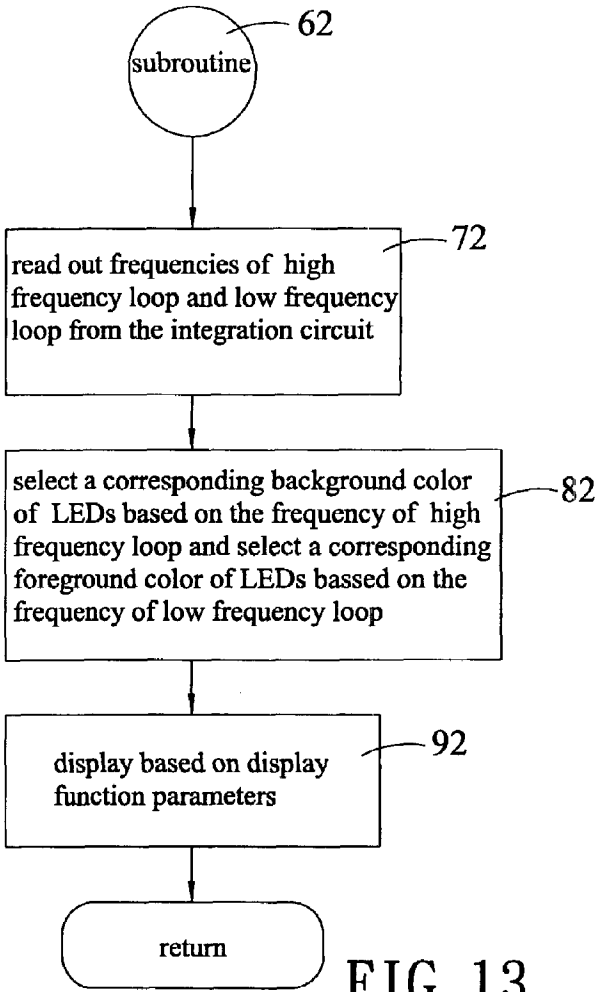
FIGS. 12 to 19 are flow charts illustrating first to eighth subroutines of the second process illustrated in FIG. 11.

The flow chart of FIG. 13 illustrates the subroutine 62 of the second process with respect to the double loop frequency control. First, read out frequencies of high frequency loop and low frequency loop from the integration circuit 30 (step 72). Next, select a corresponding background color of LEDs based on the frequency of high frequency loop and select a corresponding foreground color of LEDs based on the frequency of low frequency loop (step 82). Finally, display based on the display function parameters (step 92) prior to returning to the second process.

Figure 14:
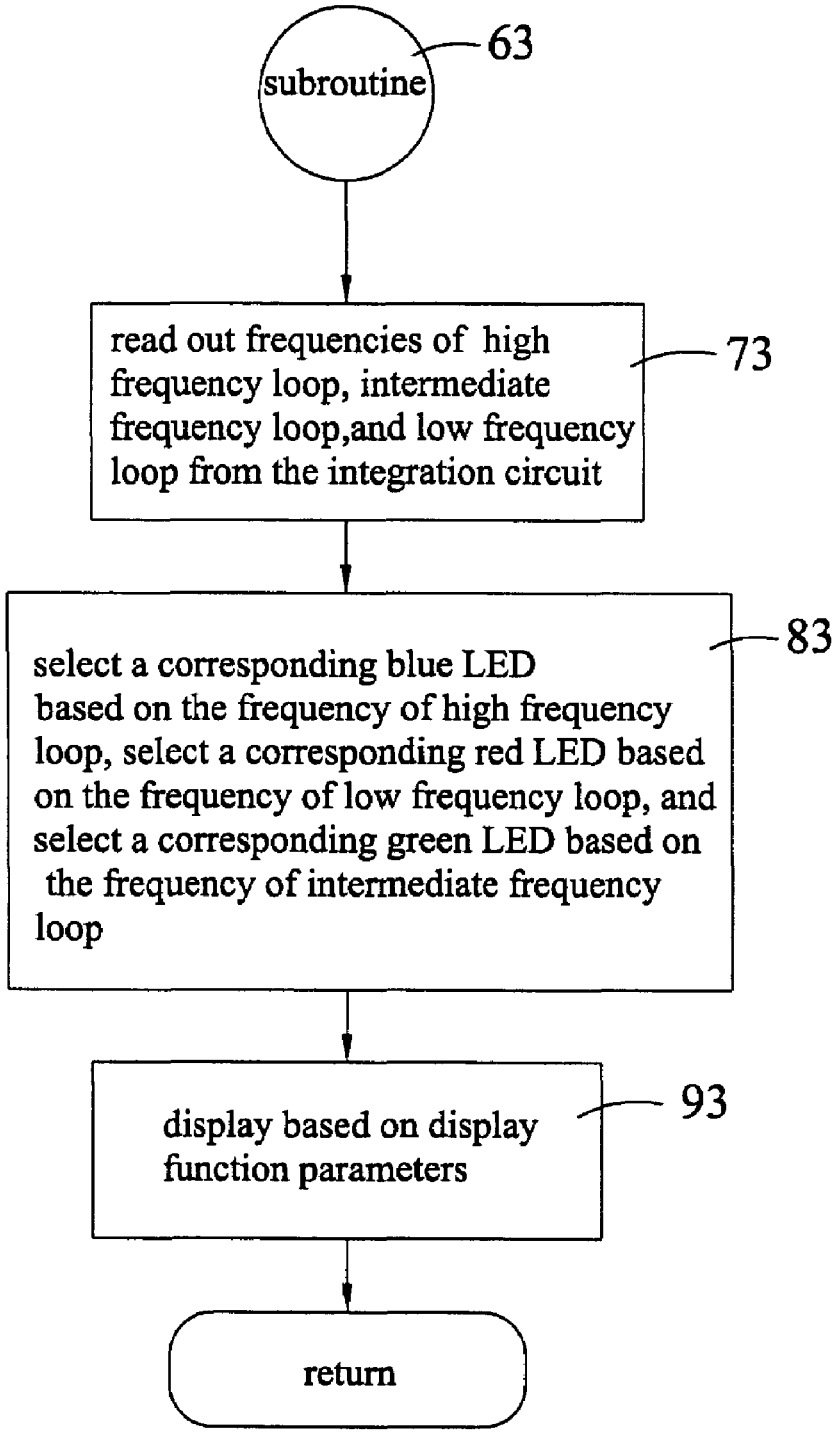

The flow chart of FIG. 14 illustrates the subroutine 63 of the second process with respect to the triple loop frequency control. First, read out frequencies of high frequency loop; intermediate frequency loop, and low frequency loop from the integration circuit 30 (step 73). Next, select a corresponding blue LED based on the frequency of high frequency loop, select a corresponding red LED based on the frequency of low frequency loop, and select a corresponding green LED based on the frequency of intermediate frequency loop (step 83). Finally, display based on the display function parameters (step 93) prior to returning to the second process.

Figure 15:
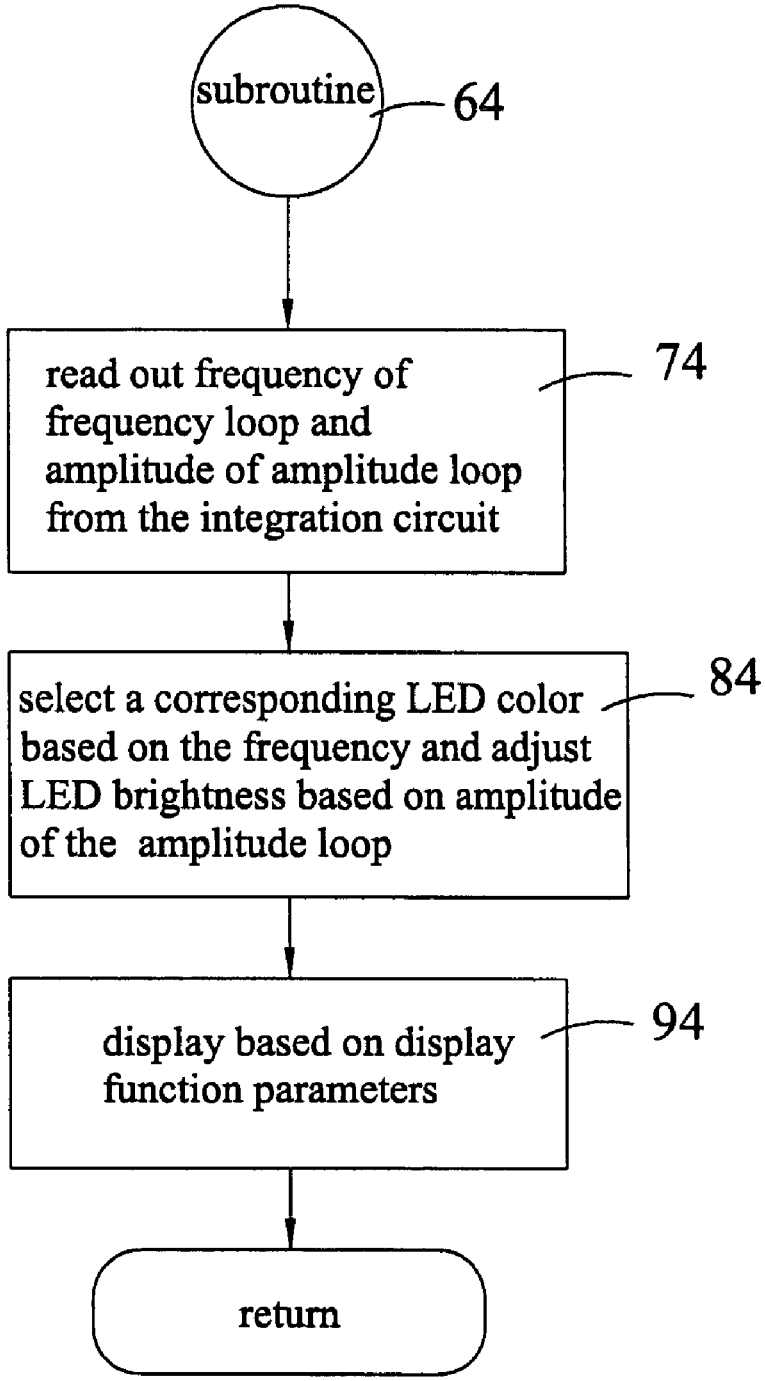

The flow chart of FIG. 15 illustrates the subroutine 64 of the second process with respect to the single loop frequency and single loop amplitude control. First, read out frequency of frequency loop and amplitude of amplitude loop from the integration circuit 30 (step 74). Next, select a corresponding LED color based on the frequency and adjust LED brightness based on amplitude of the amplitude loop (step 84). Finally, display based on the display function parameters (step 94) prior to returning to the second process.

Figure 16:
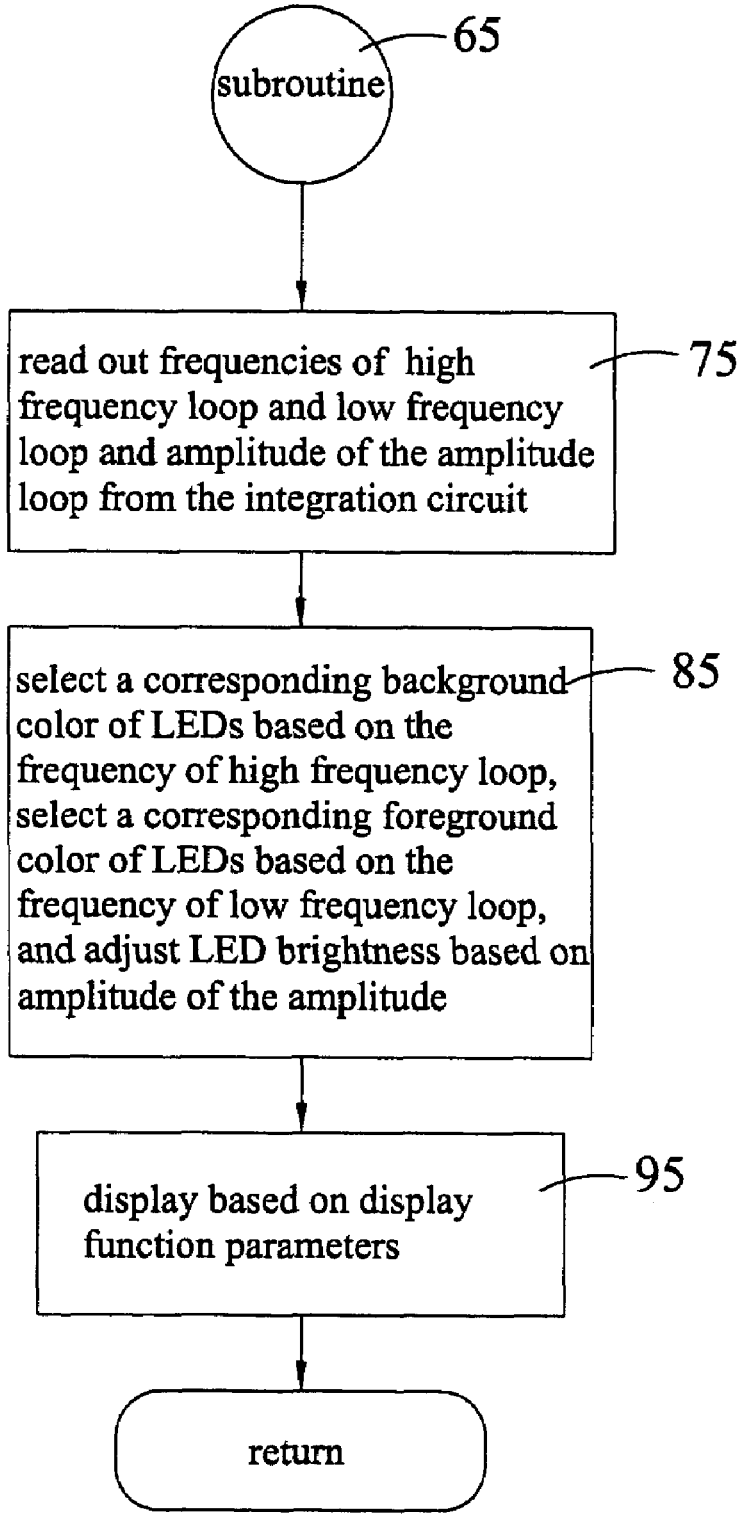
Figure 17:
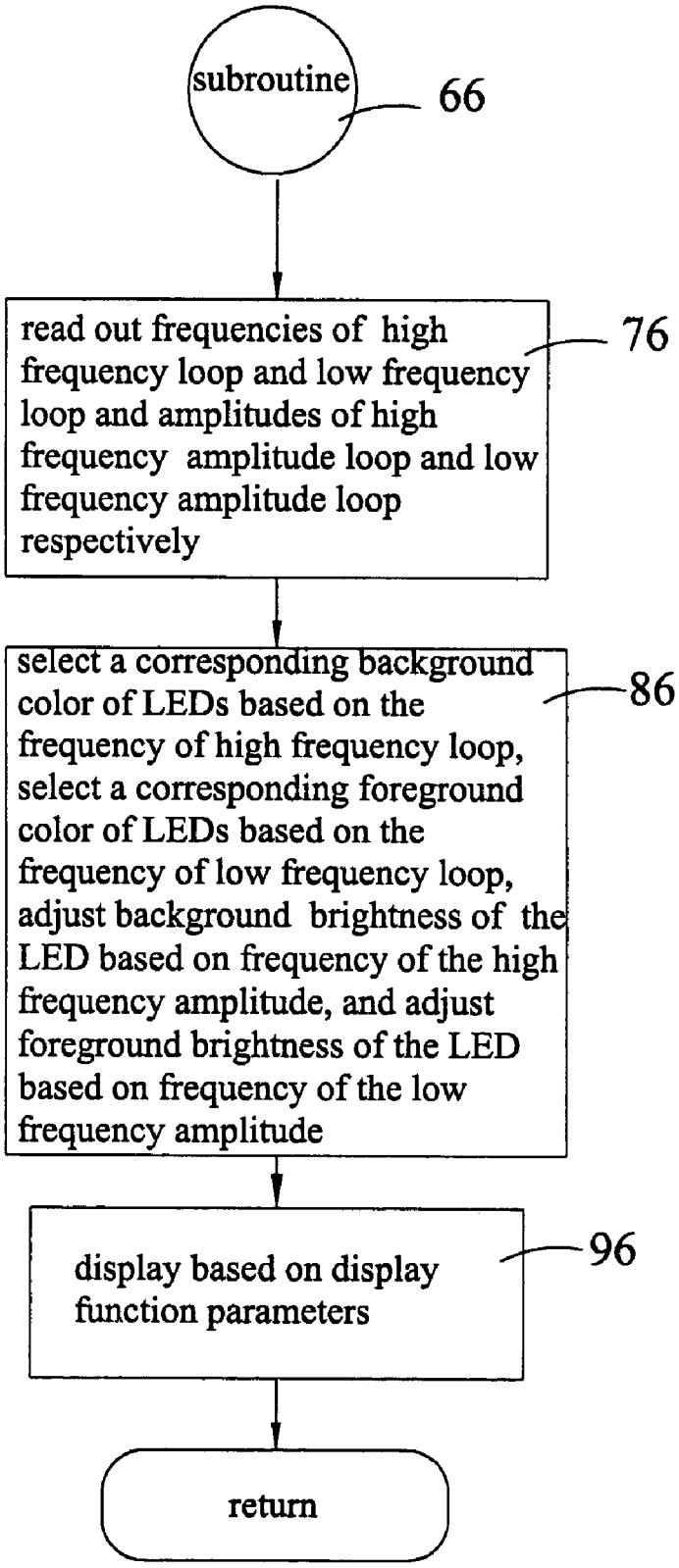

The flow chart of FIG. 16 illustrates the subroutine 65 of the second process with respect to the double loop frequency and single loop amplitude control. First, read out frequencies of high frequency loop and low frequency loop and amplitude of the amplitude loop from the integration circuit 30 (step 75). Next, select a corresponding background color of LEDs based on the frequency of high frequency loop, select a corresponding foreground color of LEDs based on the frequency of low frequency loop, and adjust LED brightness based on amplitude of the amplitude loop (step 85). Finally, display based on the display function parameters (step 95) prior to returning to the second process. The flow chart of FIG. 17 illustrates the subroutine 66 of the second process with respect to the double loop frequency and double loop amplitude control. First, read out frequencies of high frequency loop and low frequency loop and amplitudes of high frequency amplitude loop and low frequency amplitude loop respectively (step 76). Next, select a corresponding background color of LEDs based on the frequency of high frequency loop, select a corresponding foreground color of LEDs based on the frequency of low frequency loop, adjust background brightness of the LED based on frequency of the high frequency amplitude, and adjust foreground brightness of the LED based on frequency of the low frequency amplitude (step 86). Finally, display based on the display function parameters (step 96) prior to returning to the second process.

Figure 18:
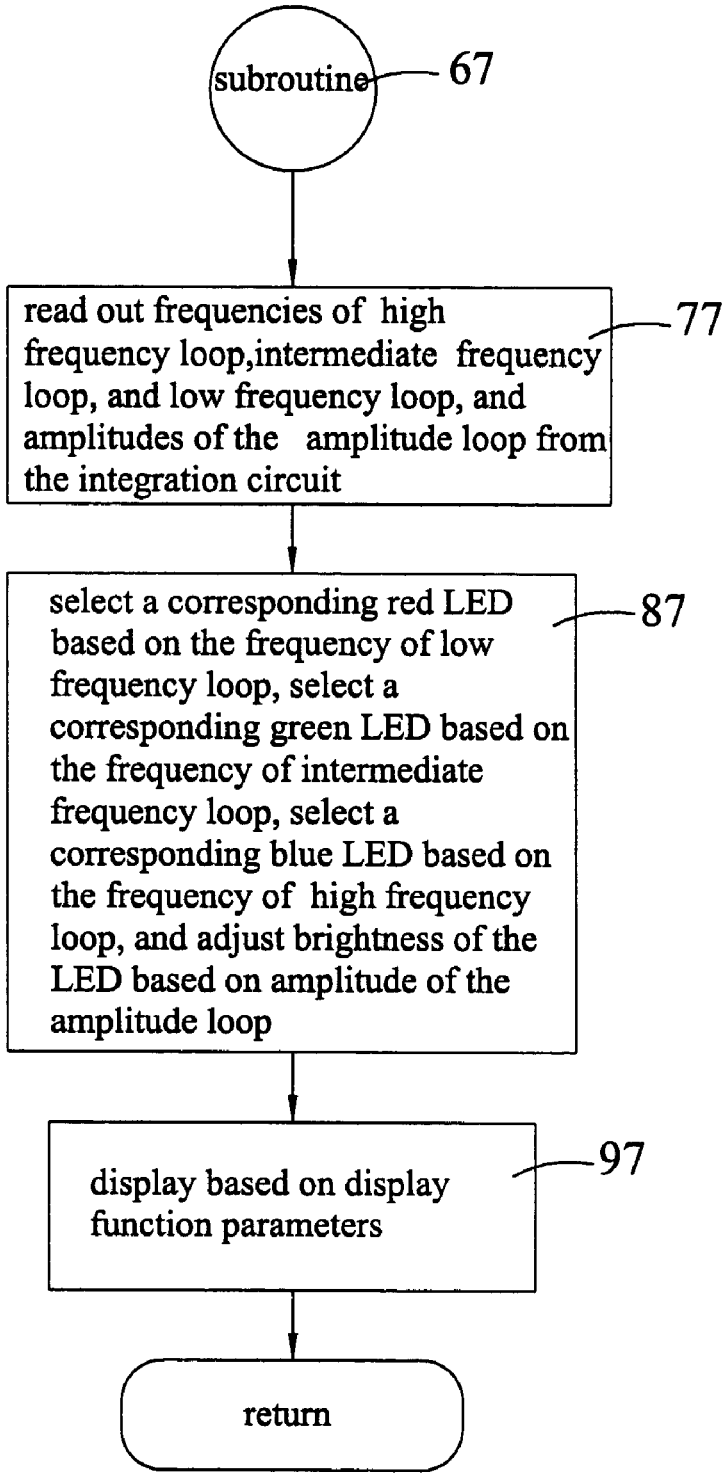

The flow chart of FIG. 18 illustrates the subroutine 67 of the second process with respect to the triple loop frequency and single loop amplitude control. First, read out frequencies of high frequency loop, intermediate frequency loop, and low frequency loop, and amplitude of the amplitude loop from the integration circuit 30 (step 77). Next, select a corresponding red LED based on the frequency of low frequency loop, select a corresponding green LED based on the frequency of intermediate frequency loop, select a corresponding blue LED based on the frequency of high frequency loop, and adjust brightness of the LED based on amplitude of the amplitude loop (step 87). Finally, display based on the display function parameters (step 97) prior to returning to the second process.

Figure 19:
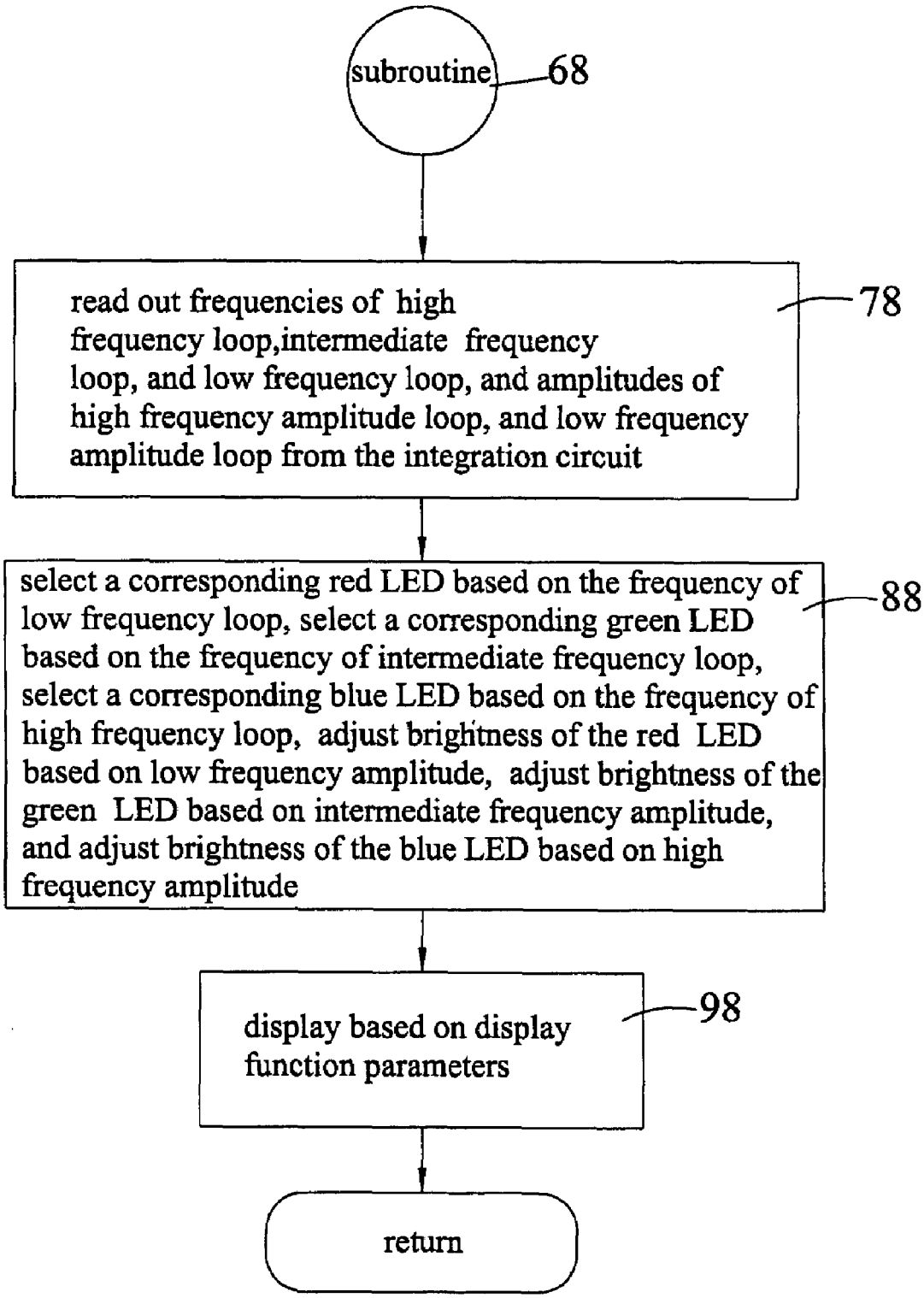

The flow chart of FIG. 19 illustrates the subroutine 68 of the second process with respect to the triple loop frequency and triple loop amplitude control. First, read out frequencies of high frequency loop, intermediate frequency loop, and low frequency loop, and amplitudes of high frequency amplitude loop, intermediate frequency amplitude loop, and low frequency amplitude loop from the integration circuit 30 (step 78). Next, select a corresponding red LED based on the frequency of low frequency loop, select a corresponding green LED based on the frequency of intermediate frequency loop, select a corresponding blue LED based on the frequency of high frequency loop, adjust brightness of the red LED based on low frequency amplitude, adjust brightness of the green LED based on intermediate frequency amplitude, and adjust brightness of the blue LED based on high frequency amplitude (step 88). Finally, display based on the display function parameters (step 98) prior to returning to the second process.

Note that the color selection methods of the invention can be different based on different sound control techniques. Fortunately, a lookup table can be employed for shortening operation time. In detail, a color conversion table comprising a single color conversion table and a full color conversion table can be created in advance based on operating results. These conversion tables are shown as follows:

single color conversion table

| | Frequency range (Hz) | Value (hex) |
|---|---|---|
| R | 20–29 | 7F |
| | 30–39 | 77 |
| | 40–49 | 6F |
| | 50–59 | 67 |
| | 60–69 | 5F |
| | . | |
| | . | |
| | . | |
| | 180–199 | BF |
| | 200–219 | AF |
| | 220–239 | 9F |
| | 240–259 | 8F |
| | 260–279 | 7F |
| | 280–299 | 6F |
| G | 300–329 | FF |
| | 330–359 | F7 |
| | 360–389 | EF |
| | 390–419 | E7 |
| | 420–449 | DF |
| | . | |
| | . | |
| | . | |
| | 4700–4749 | 2F |
| | 4750–4799 | 37 |
| | 4800–4849 | 3F |
| | 4850–4899 | 47 |
| | 4900–4949 | 4F |
| | 4950–4999 | 57 |
| B | 5000–5059 | 3F |
| | 5060–5119 | 4F |
| | 5120–5179 | 5F |

-continued

| | |
|---|---|
| 5180–5239 | 6F |
| 5240–5299 | 7F |
| . | |
| . | |
| . | |
| 19400–19499 | AF |
| 19500–19599 | 9F |
| 19600–19699 | 8F |
| 19700–19799 | 7F |
| 19800–19899 | 6F |
| 19900–19999 | 5F |

full color conversion table

| Frequency range (Hz) | R ,G ,B values (3 bytes hex) |
|---|---|
| 20–29 | FF, 0, 7F |
| 30–39 | FF, 3F, 7F |
| 40–49 | FF, 7F, 7F |
| 50–59 | FF, BF, 7F |
| 60–69 | FF, FF, 7F |
| . | . |
| . | . |
| . | . |
| 4700–4749 | FF, 0, FF |
| 4750–4799 | BF, 0, FF |
| 4800–4849 | 7F, 0, FF |
| 4850–4899 | 3F, 0, FF |
| 4900–4949 | 3F, 3F, FF |
| 4950–4999 | 3F, 7F, FF |

Note that the single color conversion table is applicable to the triple loop frequency control implemented in the third embodiment.

Further note that frequency band is chosen at a range from 20 Hz to 20 kHz with a bandwidth of 19.98 kHz when the frequency scale technique of the invention, for example, in the embodiment of single loop frequency control is carried out. As to conversion of frequency into color table, a conversion table having a memory of 19,980×3B=59,940B is required in which each color in the order of R(red), G(green), and B(blue) is represented by 3B. Larger memory space is required for any of other embodiments (control techniques) as detailed below.

A. Full frequency range equal division: Each frequency scale is 20 Hz with 999 (19,980/20=999) scales in which a first color table corresponds to 20 Hz to 39 Hz, a second color table corresponds to 40 Hz to 59 Hz, a third color table corresponds to 60 Hz to 79 Hz, . . . , and a 999th color table corresponds to 19,980 Hz to 19,999 Hz.

B. Full frequency range equal section division: The full frequency range is divided into a plurality of equal sections each being further divided into a plurality of equal scales in which the total number of scales is 303 (10+12+15+20+40+50+60+80+76=303). It only requires less than one third of the color table and has a better scale effect as compared to the full range equal division. An exemplary table is as follows:

| Frequency band serial number | Frequency range | Frequency width/ scale | Number of scale |
|---|---|---|---|
| 1 | 20–119 Hz | 10 Hz | 10 |
| 2 | 120–299 Hz | 15 Hz | 12 |
| 3 | 300–599 Hz | 20 Hz | 15 |
| 4 | 600–1199 Hz | 30 Hz | 20 |

-continued

| Frequency band serial number | Frequency range | Frequency width/ scale | Number of scale |
|---|---|---|---|
| 5 | 1200–2999 Hz | 40 Hz | 40 |
| 6 | 3000–5999 Hz | 60 Hz | 50 |
| 7 | 6000–12399 Hz | 80 Hz | 80 |
| 8 | 12400–19999 Hz | 100 Hz | 76 |

C. Full frequency range sine function calculation scale division (sin(0) to sin(90)): Bandwidth (bw) is 19,980 Hz. Number of scales is s. Frequency is f. Let f0=f−19, corresponding color table (tb)

$$tb = s \times \sin[(f0/bw) \times 90]$$

$$= s \times \sin(f0/222)$$

Choose an integral part of tb based on unconditional carry rule. For example, tb=300 sin(f0/222) if the number of scales(s) is 300. Tb is at a range of 1≦tb≦300 after choosing the integral part of tb.

Still further note that brightness adjustment by means of amplitude of the invention is detailed in the following example. Color values of R, G, and B are FF, 3F, and 7F (hex) after frequency conversion. Amplitude is 90 (hex). Amplitude ratio is 90/FF. Converted color values of R, G, and B after multiplying the amplitude ratio are as follows:

$$R = FF \times 90/FF = 90$$

$$G = 3F \times 90/FF = 23$$

$$B = 7F \times 90/FF = 47$$

In brief, the invention is directed to a full color LED based lighting apparatus operated in synchronism with music and method of controlling the same based on the sound source so as to provide lighting in synchronism with music. In short, LED color and LED brightness can be controlled by means of high and low frequencies of sound. Thus, lighting can be controlled so as to be in synchronism with music as an event proceeds. Hence, sound is excellent. Also, tenderness in one time and high spirit in the other time can be carried out as the event proceeds. Further, it is lively and shocking.

While the invention herein disclosed has been described by means of specific embodiments, numerous modifications and variations could be made thereto by those skilled in the art without departing from the scope and spirit of the invention set forth in the claims.

What is claimed is:

1. A full color LED (light-emitting diode) based lighting apparatus operated in synchronism with music comprising an audio frequency band-pass filter, a level comparator, an integration circuit, a microcontroller, and an LED drive circuit wherein:

the audio frequency band-pass filter is adapted to filter out signals other than a sound source in sound input for obtaining sound signals and amplify the sound signals prior to inputting to the level comparator;

the level comparator is adapted to further amplify the sound signals and convert amplified signals having a voltage higher than a reference voltage into square-wave signals prior to inputting to the integration circuit for frequency calculation;

the microcontroller comprises a CPU (central processing unit), a RAM (random access memory), and a ROM (read only memory) having a firmware for controlling the CPU; and the integration circuit is adapted to process the square-wave signals fed from the level comparator for obtaining a corresponding frequency which is stored in a register so that the CPU is adapted to read out the frequency from the register, process input/output (I/O) and scan signals sent from the CPU, and send the processed signals to the LED drive circuit for controlling LED color, whereby the full color LED based lighting apparatus operated in synchronism with music is adapted to be controlled by a single loop frequency.

2. A full color LED based lighting apparatus operated in synchronism with music comprising an audio frequency band-pass filter, a high frequency band-pass amplification circuit, a low frequency band-pass amplification circuit, an integration circuit, a microcontroller, and an LED drive circuit wherein:

the audio frequency band-pass filter is adapted to filter out signals other than a sound source in sound input for obtaining sound signals and amplify the sound signals prior to inputting to the high frequency band-pass amplification circuit and the low frequency band-pass amplification circuit respectively;

the high frequency band-pass amplification circuit comprises a first level comparator together with the high frequency band-pass amplification circuit for forming a first detection loop of high frequency band being adapted to further amplify signals having a high frequency band and convert the amplified signals having a voltage higher than a reference voltage into square-wave signals prior to inputting to the integration circuit for frequency calculation;

the low frequency band-pass amplification circuit comprises a second level comparator together with the low frequency band-pass amplification circuit for forming a second detection loop of low frequency band being adapted to further amplify signals having a low frequency band and convert the amplified signals having a voltage higher than the reference voltage into square-wave signals prior to inputting to the integration circuit for frequency calculation;

the microcontroller comprises a CPU, a RAM, and a ROM having a firmware for controlling the CPU; and the integration circuit is adapted to process the square-wave signals fed from the first level comparator for obtaining a corresponding frequency which is stored in a register so that the CPU is adapted to read out the frequency from the register, process I/O and scan signals sent from the CPU, and send the processed signals to the LED drive circuit for controlling background color of LEDs; the integration circuit is adapted to process the square-wave signals fed from the second level comparator for obtaining a corresponding frequency in response to input from the second detection loop, the corresponding frequency being stored in the register so that the CPU is adapted to read out the frequency from the register; and the integration circuit is adapted to process I/O and scan signals sent from the CPU, and send the processed signals to the LED drive circuit for controlling foreground color of LEDs, whereby dividing an audio frequency into a high frequency band and a low frequency band, causing one frequency band to control background color of LEDs, and causing the other one to control foreground color of LEDs will cause the full color LED based lighting apparatus operated in synchronism with music to be controlled by a double loop frequency.

3. The apparatus of claim 2, wherein the first detection loop of high frequency band is adapted to control foreground color of LEDs by means of the frequency and the second detection loop of high frequency band is adapted to control background color of LEDs by means of the frequency.

4. A full color LED based lighting apparatus operated in synchronism with music comprising an audio frequency band-pass filter, a high frequency band-pass amplification circuit, a low frequency band-pass amplification circuit, an intermediate frequency band-pass amplification circuit an integration circuit, a microcontroller, and an LED drive circuit wherein:

the audio frequency band-pass filter is adapted to filter out signals other than a sound source in sound input for obtaining sound signals and amplify the sound signals prior to inputting to the high frequency band-pass amplification circuit, the imtermediate frequency band-pass amplification circuit, and the low frequency band-pass amplification circuit respectively;

the high frequency band-pass amplification circuit comprises a first level comparator together with the high frequency band-pass amplification circuit for forming a first detection loop of high frequency band being adapted to further amplify signals having a high frequency band and convert the amplified signals having a voltage higher than a reference voltage into square-wave signals prior to inputting to the integration circuit for frequency calculation;

the low frequency band-pass amplification circuit comprises a second level comparator together with the low frequency band-pass amplification circuit for forming a second detection loop of low frequency band being adapted to further amplify signals having a low frequency band and convert the amplified signals having a voltage higher than the reference voltage into square-wave signals prior to inputting to the integration circuit for frequency calculation;

the intermediate frequency band-pass amplification circuit comprises a third level comparator together with the intermediate frequency band-pass amplification circuit for forming a third detection loop of intermediate frequency band being adapted to further amplify signals having an intermediate frequency band and convert the amplified signals having a voltage higher than the reference voltage into square-wave signals prior to inputting to the integration circuit for frequency calculation;

the microcontroller comprises a CPU, a RAM, and a ROM having a firmware for controlling the CPU; and the integration circuit is adapted to process the square-wave signals fed from the first level comparator for obtaining a corresponding frequency which is stored in a register so that the CPU is adapted to read out the frequency from the register, process I/O and scan signals sent from the CPU, and send the processed signals to the LED drive circuit for controlling blue LEDs; the integration circuit is adapted to process the square-wave signals fed from the second level comparator for obtaining a corresponding frequency in response to input from the second detection loop, the corresponding frequency being stored in the register so that the CPU is adapted to read out the frequency from the register, process I/O and scan signals sent from the CPU, and send the processed signals to the LED drive circuit for controlling red LEDs; and the integration circuit is adapted to process the square-wave signals fed from the third level comparator for obtaining a corresponding frequency in response to input from the third detection loop, the corresponding frequency being stored in the register so that the CPU is adapted to read out the frequency from the register, process I/O and scan signals sent from the CPU, and send the processed signals to the LED drive circuit for controlling green LEDs, whereby dividing an audio frequency into a high frequency band, an intermediate frequency band, and a low frequency band, causing the high frequency band to control blue LEDs, causing the intermediate frequency band to control green LEDs, and causing the low frequency band to control red LEDs will cause the full color LED based lighting apparatus operated in synchronism with music to be controlled by a triple loop frequency.

5. The apparatus of claim 4, wherein one of the followings is performed: the integration circuit is adapted to process the square-wave signals fed from the first level comparator for controlling blue LEDs, the integration circuit is adapted to process the square-wave signals fed from the second level comparator for controlling green LEDs, and the integration circuit is adapted to process the square-wave signals fed from the third level comparator for controlling red LEDs; the integration circuit is adapted to process the square-wave signals fed from the first level comparator for controlling red LEDs, the integration circuit is adapted to process the square-wave signals fed from the second level comparator for controlling blue LEDs, and the integration circuit is adapted to process the square-wave signals fed from the third level comparator for controlling green LEDs; the integration circuit is adapted to process the square-wave signals fed from the first level comparator for controlling red LEDs, the integration circuit is adapted to process the square-wave signals fed from the second level comparator for controlling green LEDs, and the integration circuit is adapted to process the square-wave signals fed from the third level comparator for controlling blue LEDs; the integration circuit is adapted to process the square-wave signals fed from the first level comparator for controlling green LEDs, the integration circuit is adapted to process the square-wave signals fed from the second level comparator for controlling blue LEDs, and the integration circuit is adapted to process the square-wave signals fed from the third level comparator for controlling red LEDs; and the integration circuit is adapted to process the square-wave signals fed from the first level comparator for controlling green LEDs, the integration circuit is adapted to process the square-wave signals fed from the second level comparator for controlling red LEDs, and the integration circuit is adapted to process the square-wave signals fed from the third level comparator for controlling blue LEDs.

6. A full color LED based lighting apparatus operated in synchronism with music comprising an audio frequency band-pass filter, a first amplitude detection circuit, a band-pass amplification circuit, an integration circuit, a microcontroller, and an LED drive circuit wherein:

the audio frequency band-pass filter is adapted to filter out signals other than a sound source in sound input for obtaining sound signals and amplify the sound signals prior to inputting to the first amplitude detection circuit and the band-pass amplification circuit respectively;

the first amplitude detection circuit comprises an ADC (analog-to-digital converter) together with the first amplitude detection circuit for forming an amplitude detection loop being adapted to obtain peaks of signals and convert the peaks of signals into digital amplitudes of signals by means of the ADC prior to inputting to the integration circuit for reading;

the band-pass amplification circuit comprises a fourth level comparator together with the band-pass amplification circuit for forming a frequency detection loop being is adapted to further amplify signals and convert the amplified signals having a voltage higher than a reference voltage into square-wave signals prior to inputting to the integration circuit for frequency calculation;

the microcontroller comprises a CPU, a RAM, and a ROM having a firmware for controlling the CPU; and the integration circuit is adapted to store the amplitudes of signals in a register in response to input from the ADC so that the CPU is adapted to read out the amplitudes of signals fed from the register, process I/O and scan signals sent from the CPU, and send the processed signals to the LED drive circuit for controlling LED brightness; the integration circuit is adapted to store the square-wave signals in the register in response to input from the fourth level comparator so that the CPU is adapted to read out the square-wave signals from the register; and the integration circuit is adapted to process I/O and scan signals sent from the CPU, and send the processed signals to the LED drive circuit for controlling LED color, whereby controlling LED color by changing a loop frequency and controlling LED brightness by changing a loop amplitude will cause the full color LED based lighting apparatus operated in synchronism with music to be controlled by a single loop frequency and a single loop amplitude.

7. A full color LED based lighting apparatus operated in synchronism with music comprising an audio frequency band-pass filter, a high frequency band-pass amplification circuit, a low frequency band-pass amplification circuit, a first amplitude detection circuit, an integration circuit, a microcontroller, and an LED drive circuit wherein:

the audio frequency band-pass filter is adapted to filter out signals other than a sound source in sound input for obtaining sound signals and amplify the sound signals prior to inputting to the high frequency band-pass amplification circuit, the low frequency band-pass amplification circuit, and the first amplitude detection circuit respectively;

the high frequency band-pass amplification circuit comprises a first level comparator together with the high frequency band-pass amplification circuit for forming a first detection loop of high frequency band being adapted to further amplify signals having a high frequency band and convert the amplified signals having a voltage higher than a reference voltage into square-wave signals prior to inputting to the integration circuit for frequency calculation;

the low frequency band-pass amplification circuit comprises a second level comparator together with the low frequency band-pass amplification circuit for forming a second detection loop of low frequency band being adapted to further amplify signals having a low frequency band and convert the amplified signals having a voltage higher than the reference voltage into square-wave signals prior to inputting to the integration circuit for frequency calculation;

the first amplitude detection circuit comprises an ADC together with the first amplitude detection circuit for forming an amplitude detection loop being adapted to obtain peaks of signals and convert the peaks of signals into digital amplitudes of signals by means of the ADC prior to inputting to the integration circuit for reading;

the microcontroller comprises a CPU, a RAM, and a ROM having a firmware for controlling the CPU; and the integration circuit is adapted to process the square-wave signals fed from the first level comparator for obtaining a corresponding frequency which is stored in a register so that the CPU is adapted to read out the frequency from the register, process I/O and scan signals sent from the CPU, and send the processed signals to the LED drive circuit for controlling background color of LEDs; the integration circuit is adapted to process the square-wave signals fed from the second level comparator for obtaining a corresponding frequency which is stored in the register so that the CPU is adapted to read out the frequency from the register, process I/O and scan signals sent from the CPU, and send the processed signals to the LED drive circuit for controlling foreground color of LEDs; and the integration circuit is adapted to store the amplitudes of signals in the register in response to input from the ADC so that the CPU is adapted to read out the amplitudes of signals fed from the register, process I/O and scan signals sent from the CPU, and send the processed signals to the LED drive circuit for controlling a whole LED brightness, whereby dividing an audio frequency into a high frequency band and a low frequency band, causing one frequency band to control background color of LEDs, causing the other one to control foreground color of LEDs, and controlling the whole LED brightness by a loop amplitude will cause the full color LED based lighting apparatus operated in synchronism with music to be controlled by a double loop frequency and a single loop amplitude.

8. The apparatus of claim 7, wherein the first detection loop of high frequency band is adapted to control foreground color of LEDs by means of the frequency and the second detection loop of high frequency band is adapted to control background color of LEDs by means of the frequency.

9. A full color LED based lighting apparatus operated in synchronism with music comprising an audio frequency band-pass filter, a high frequency band-pass amplification circuit, a low frequency band-pass amplification circuit, a second amplitude detection circuit, a third amplitude detection circuit, an integration circuit, a microcontroller, and an LED drive circuit wherein:

the audio frequency band-pass filter is adapted to filter out signals other than a sound source in sound input for obtaining sound signals and amplify the sound signals prior to inputting to the high frequency band-pass amplification circuit and the low frequency band-pass amplification circuit respectively;

the high frequency band-pass amplification circuit comprises a first level comparator together with the high frequency band-pass amplification circuit for forming a first detection loop of high frequency band being adapted to further amplify signals having a high frequency band and convert the amplified signals having a voltage higher than a reference voltage into square-wave signals prior to inputting to the integration circuit for frequency calculation;

the low frequency band-pass amplification circuit comprises a second level comparator together with the low frequency band-pass amplification circuit for forming a second detection loop of low frequency band being adapted to further amplify signals having a low frequency band and convert the amplified signals having a voltage higher than the reference voltage into square-wave signals prior to inputting to the integration circuit for frequency calculation;

the first amplitude detection circuit comprises a first ADC together with the first amplitude detection circuit for forming a detection loop of high frequency amplitude being adapted to obtain peaks of signals having a high frequency and convert the peaks of signals into digital amplitudes of signals by means of the first ADC prior to inputting to the integration circuit for reading;

the second amplitude detection circuit comprises a second ADC together with the second amplitude detection circuit for forming a detection loop of low frequency amplitude being adapted to obtain peaks of signals having a low frequency and convert the peaks of signals into digital amplitudes of signals by means of the second ADC prior to inputting to the integration circuit for reading;

the microcontroller comprises a CPU, a RAM, and a ROM having a firmware for controlling the CPU; and the integration circuit is adapted to process the square-wave signals fed from the first level comparator for obtaining a corresponding frequency which is stored in a register so that the CPU is adapted to read out the frequency from the register, process I/O and scan signals sent from the CPU, and send the processed signals to the LED drive circuit for controlling background color of LEDs; the integration circuit is adapted to process the square-wave signals fed from the second level comparator for obtaining a corresponding frequency which is stored in the register so that the CPU is adapted to read out the frequency from the register, process I/O and scan signals sent from the CPU, and send the processed signals to the LED drive circuit for controlling foreground color of LEDs; the integration circuit is adapted to store the amplitudes of signals in the register in response to input from the first ADC so that the CPU is adapted to read out the amplitudes of signals fed from the register, process I/O and scan signals sent from the CPU, and send the processed signals to the LED drive circuit for controlling brightness of the first detection loop; and the integration circuit is adapted to store the amplitudes of signals in the register in response to input from the second ADC so that the CPU is adapted to read out the amplitudes of signals fed from the register, process I/O and scan signals sent from the CPU, and send the processed signals to the LED drive circuit for controlling brightness of the second detection loop, whereby dividing an audio frequency into a high frequency band and a low frequency band, causing one frequency band to control background color of LEDs, causing the other one to control foreground color of LEDs, and controlling a loop brightness by a loop amplitude will cause the full color LED based lighting apparatus operated in synchronism with music to be controlled by a double loop frequency and a double loop amplitude.

10. A full color LED based lighting apparatus operated in synchronism with music comprising an audio frequency band-pass filter, a high frequency band-pass amplification circuit, a low frequency band-pass amplification circuit, an intermediate frequency band-pass amplification circuit, a first amplitude detection circuit, an integration circuit, a microcontroller, and an LED drive circuit wherein:

the audio frequency band-pass filter is adapted to filter out signals other than a sound source in sound input for obtaining sound signals and amplify the sound signals prior to inputting to the high frequency band-pass amplification circuit, the low frequency band-pass amplification circuit, and the intermediate frequency band-pass amplification circuit respectively;

the high frequency band-pass amplification circuit comprises a first level comparator together with the high frequency band-pass amplification circuit for forming a first detection loop of high frequency band being adapted to further amplify signals having a high frequency band and convert the amplified signals having a voltage higher than a reference voltage into square-wave signals prior to inputting to the integration circuit for frequency calculation;

the low frequency band-pass amplification circuit comprises a second level comparator together with the low frequency band-pass amplification circuit for forming a second detection loop of low frequency band being adapted to further amplify signals having a low frequency band and convert the amplified signals having a voltage higher than the reference voltage into square-wave signals prior to inputting to the integration circuit for frequency calculation;

the intermediate frequency band-pass amplification circuit comprises a third level comparator together with the intermediate frequency band-pass amplification circuit for forming a third detection loop of intermediate frequency band being adapted to further amplify signals having an intermediate frequency band and convert the amplified signals having a voltage higher than the reference voltage into square-wave signals prior to inputting to the integration circuit for frequency calculation;

the first amplitude detection circuit comprises an ADC together with the first amplitude detection circuit for forming an amplitude detection loop being adapted to obtain peaks of signals and convert the peaks of signals into digital amplitudes of signals by means of the ADC prior to inputting to the integration circuit for reading;

the microcontroller comprises a CPU, a RAM, and a ROM having a firmware for controlling the CPU; and the integration circuit is adapted to process the square-wave signals fed from the first level comparator for obtaining a corresponding frequency which is stored in a register so that the CPU is adapted to read out the frequency from the register, process I/O and scan signals sent from the CPU, and send the processed signals to the LED drive circuit for controlling blue LEDs; the integration circuit is adapted to process the square-wave signals fed from the second level comparator for obtaining a corresponding frequency in response to input from the second detection loop, the corresponding frequency being stored in the register so that the CPU is adapted to read out the frequency from the register, process I/O and scan signals sent from the CPU, and send the processed signals to the LED drive circuit for controlling red LEDs; the integration circuit is adapted to process the square-wave signals fed from the third level comparator for obtaining a corresponding frequency in response to input from the third detection loop, the corresponding frequency being stored in the register so that the CPU is adapted to read out the frequency from the register, process I/O and scan signals sent from the CPU, and send the processed signals to the LED drive circuit for controlling green LEDs; and the integration circuit is adapted to store the amplitudes of signals in the register in response to input from the ADC so that the CPU is adapted to read out the amplitudes of signals fed from the register, process I/O and scan signals sent from the CPU, and send the processed signals to the LED drive circuit for controlling a whole LED brightness, whereby dividing an audio frequency into a high frequency band, an intermediate frequency band, and a low frequency band for controlling blue, red, and green color LEDs respectively, and controlling the whole LED brightness by a loop amplitude will cause the full color LED based lighting apparatus operated in synchronism with music to be controlled by a triple loop frequency and a single loop amplitude.

11. The apparatus of claim 10, wherein one of the followings is performed: the integration circuit is adapted to process the square-wave signals fed from the first level comparator for controlling blue LEDs, the integration circuit is adapted to process the square-wave signals fed from the second level comparator for controlling green LEDs, and the integration circuit is adapted to process the square-wave signals fed from the third level comparator for controlling red LEDs; the integration circuit is adapted to process the square-wave signals fed from the first level comparator for controlling red LEDs, the integration circuit is adapted to process the square-wave signals fed from the second level comparator for controlling blue LEDs, and the integration circuit is adapted to process the square-wave signals fed from the third level comparator for controlling green LEDs; the integration circuit is adapted to process the square-wave signals fed from the first level comparator for controlling red LEDs, the integration circuit is adapted to process the square-wave signals fed from the second level comparator for controlling green LEDs, and the integration circuit is adapted to process the square-wave signals fed from the third level comparator for controlling blue LEDs; the integration circuit is adapted to process the square-wave signals fed from the first level comparator for controlling green LEDs, the integration circuit is adapted to process the square-wave signals fed from the second level comparator for controlling blue LEDs, and the integration circuit is adapted to process the square-wave signals fed from the third level comparator for controlling red LEDs; and the integration circuit is adapted to process the square-wave signals fed from the first level comparator for controlling green LEDs, the integration circuit is adapted to process the square-wave signals fed from the second level comparator for controlling red LEDs, and the integration circuit is adapted to process the square-wave signals fed from the third level comparator for controlling blue LEDs.

12. A full color LED based lighting apparatus operated in synchronism with music comprising an audio frequency band-pass filter, a high frequency band-pass amplification circuit, a low frequency band-pass amplification circuit, an intermediate frequency band-pass amplification circuit, a second amplitude detection circuit, a third amplitude detection circuit, a fourth amplitude detection circuit, an integration circuit, a microcontroller, and an LED drive circuit wherein:

the audio frequency band-pass filter is adapted to filter out signals other than a sound source in sound input for obtaining sound signals and amplify the sound signals prior to inputting to the high frequency band-pass amplification circuit, the low frequency band-pass amplification circuit, and the intermediate frequency band-pass amplification circuit respectively;

the high frequency band-pass amplification circuit comprises a first level comparator together with the high frequency band-pass amplification circuit for forming a first detection loop of high frequency band being adapted to further amplify signals having a high frequency band and convert the amplified signals having a voltage higher than a reference voltage into square-wave signals prior to inputting to the integration circuit for frequency calculation;

the low frequency band-pass amplification circuit comprises a second level comparator together with the low frequency band-pass amplification circuit for forming a second detection loop of low frequency band being adapted to further amplify signals having a low frequency band and convert the amplified signals having a voltage higher than the reference voltage into square-wave signals prior to inputting to the integration circuit for frequency calculation;

the intermediate frequency band-pass amplification circuit comprises a third level comparator together with the intermediate frequency band-pass amplification circuit for forming a third detection loop of intermediate frequency band being adapted to further amplify signals having an intermediate frequency band and convert the amplified signals having a voltage higher than the reference voltage into square-wave signals prior to inputting to the integration circuit for frequency calculation;

the second amplitude detection circuit comprises a first ADC together with the second amplitude detection circuit for forming a detection loop of high frequency amplitude being adapted to obtain peaks of signals having a high frequency and convert the peaks of signals into digital high frequency amplitudes of signals by means of the first ADC prior to inputting to the integration circuit for reading;

the third amplitude detection circuit comprises a second ADC together with the third amplitude detection circuit for forming a detection loop of low frequency amplitude being adapted to obtain peaks of signals having a low frequency and convert the peaks of signals into digital low frequency amplitudes of signals by means of the second ADC prior to inputting to the integration circuit for reading;

the fourth amplitude detection circuit comprises a third ADC together with the third amplitude detection circuit for forming a detection loop of intermediate frequency amplitude being adapted to obtain peaks of signals having an intermediate frequency and convert the peaks of signals into digital intermediate frequency amplitudes of signals by means of the third ADC prior to inputting to the integration circuit for reading;

the microcontroller comprises a CPU, a RAM, and a ROM having a firmware for controlling the CPU; and the integration circuit is adapted to process the square-wave signals fed from the first level comparator for obtaining a corresponding frequency which is stored in a register so that the CPU is adapted to read out the frequency from the register, process I/O and scan signals sent from the CPU, and send the processed signals to the LED drive circuit for controlling blue LEDs; the integration circuit is adapted to process the square-wave signals fed from the second level comparator for obtaining a corresponding frequency in response to input from the second detection loop, the corresponding frequency being stored in the register so that the CPU is adapted to read out the frequency from the register, process I/O and scan signals sent from the CPU, and send the processed signals to the LED drive circuit for controlling red LEDs; the integration circuit is adapted to process the square-wave signals fed from the third level comparator for obtaining a corresponding frequency in response to input from the third detection loop, the corresponding frequency being stored in the register so that the CPU is adapted to read out the frequency from the register, process I/O and scan signals sent from the CPU, and send the processed signals to the LED drive circuit for controlling green LEDs; the integration circuit is adapted to store the amplitudes of signals in the register in response to input from the first ADC so that the CPU is adapted to read out the amplitudes of signals fed from the register, process I/O and scan signals sent from the CPU, and send the processed signals to the LED drive circuit for controlling brightness of the first detection loop; the integration circuit is adapted to store the amplitudes of signals in the register in response to input from the second ADC so that the CPU is adapted to read out the amplitudes of signals fed from the register, process I/O and scan signals sent from the CPU, and send the processed signals to the LED drive circuit for controlling brightness of the second detection loop; and the integration circuit is adapted to store the amplitudes of signals in the register in response to input from the third ADC so that the CPU is adapted to read out the amplitudes of signals fed from the register, process I/O and scan signals sent from the CPU, and send the processed signals to the LED drive circuit for controlling brightness of the third detection loop, whereby dividing an audio frequency into a high frequency band, an intermediate frequency band, and a low frequency band for controlling blue, red, and green color LEDs respectively, and controlling a loop brightness by a loop amplitude will cause the full color LED based lighting apparatus operated in synchronism with music to be controlled by a triple loop frequency and triple loop amplitude.

13. The apparatus of claim 12, wherein one of the followings is performed: the integration circuit is adapted to process the square-wave signals fed from the first level comparator for controlling blue LEDs, the integration circuit is adapted to process the square-wave signals fed from the second level comparator for controlling green LEDs, and the integration circuit is adapted to process the square-wave signals fed from the third level comparator for controlling red LEDs; the integration circuit is adapted to process the square-wave signals fed from the first level comparator for controlling red LEDs, the integration circuit is adapted to process the square-wave signals fed from the second level comparator for controlling blue LEDs, and the integration circuit is adapted to process the square-wave signals fed from the third level comparator for controlling green LEDs; the integration circuit is adapted to process the square-wave signals fed from the first level comparator for controlling red LEDs, the integration circuit is adapted to process the square-wave signals fed from the second level comparator for controlling green LEDs, and the integration circuit is adapted to process the square-wave signals fed from the third level comparator for controlling blue LEDs; the integration circuit is adapted to process the square-wave signals fed from the first level comparator for controlling green LEDs, the integration circuit is adapted to process the square-wave signals fed from the second level comparator for controlling blue LEDs, and the integration circuit is adapted to process the square-wave signals fed from the third level comparator for controlling red LEDs; and the integration circuit is adapted to process the square-wave signals fed from the first level comparator for controlling green LEDs, the integration circuit is adapted to process the square-wave signals fed from the second level comparator for controlling red LEDs, and the integration circuit is adapted to process the square-wave signals fed from the third level comparator for controlling blue LEDs.

14. In a full color LED based lighting apparatus operated in synchronism with music including an audio frequency band-pass filter, a level comparator, an integration circuit, a microcontroller, and an LED drive circuit, a method of controlling the full color LED based lighting control apparatus with respect to a single loop frequency, the method comprising the steps of: initializing a register and I/O (input/output) values, clearing an SRAM (static RAM), and set parameters; reading out display function parameters from an input port; determining a machine type from a read machine type parameter; and calling one of a plurality of subroutines based on the machine type wherein a first subroutine with respect to the single loop frequency comprises the steps of:

reading out a frequency from the integration circuit;

selecting a corresponding LED color based on the frequency; and displaying based on display function parameters prior to returning.

15. The method of claim 14, wherein the full color LED based lighting apparatus operated in synchronism with music comprises an audio frequency band-pass filter, a high frequency band-pass amplification circuit, a first level comparator, a low frequency band-pass amplification circuit, a second level comparator, an integration circuit, a microcontroller, and an LED drive circuit, and a second subroutine with respect to a double loop frequency comprises the steps of:

reading out frequencies of a high frequency loop and a low frequency loop from the integration circuit;

selecting a corresponding background color of LEDs based on the frequency of the high frequency loop and selecting a corresponding foreground color of the LEDs based on the frequency of the low frequency loop; and displaying based on the display function parameters prior to returning.

16. The method of claim 14, wherein the full color LED based lighting apparatus operated in synchronism with music comprises an audio frequency band-pass filter, a high frequency band-pass amplification circuit, a first level comparator, a low frequency band-pass amplification circuit, a second level comparator, an intermediate frequency band-pass amplification circuit, a third level comparator, an integration circuit, a microcontroller, and an LED drive circuit, and a third subroutine with respect to a triple loop frequency comprises the steps of:

reading out frequencies of a high frequency loop, an intermediate frequency loop, and a low frequency loop from the integration circuit;

selecting a corresponding blue LED based on the frequency of the high frequency loop, selecting a corresponding red LED based on the frequency of the low frequency loop, and selecting a corresponding green LED based on the frequency of the intermediate frequency loop; and displaying based on the display function parameters prior to returning.

17. The method of claim 14, wherein the full color LED based lighting apparatus operated in synchronism with music comprises an audio frequency band-pass filter, a first amplitude detection circuit, a first ADC, a band-pass amplification circuit, a fourth level comparator, an integration circuit, a microcontroller, and an LED drive circuit, and a fourth subroutine with respect to a single loop frequency and a single loop amplitude comprises the steps of:

reading out a frequency of a frequency loop and an amplitude of an amplitude loop from the integration circuit;

selecting a corresponding LED color based on the frequency and adjusting LED brightness based on the amplitude of the amplitude loop; and displaying based on the display function parameters prior to returning.

18. The method of claim 14, wherein the full color LED based lighting apparatus operated in synchronism with music comprises an audio frequency band-pass filter, a high frequency band-pass amplification circuit, a first level comparator, a low frequency band-pass amplification circuit, a second level comparator, a first amplitude detection circuit, an integration circuit, a microcontroller, and an LED drive circuit, and a fifth subroutine with respect to a double loop frequency and a single loop amplitude comprises the steps of:

reading out frequencies of a high frequency loop and a low frequency loop and an amplitude of an amplitude loop from the integration circuit;

selecting a corresponding background color of LEDs based on the frequency of the high frequency loop, selecting a corresponding foreground color of the LEDs based on the frequency of the low frequency loop, and adjusting LED brightness based on the amplitude of the amplitude loop; and displaying based on the display function parameters prior to returning.

19. The method of claim 14 wherein the full color LED based lighting apparatus operated in synchronism with music comprises an audio frequency band-pass filter, a high frequency band-pass amplification circuit, a first level comparator, a low frequency band-pass amplification circuit, a second level comparator, a second amplitude detection circuit, a first ADC, a third amplitude detection circuit, a second ADC, an integration circuit, a microcontroller, and an LED drive circuit, and a sixth subroutine with respect to a double loop frequency and a double loop amplitude comprises the steps of:

reading out frequencies of a high frequency loop and a low frequency loop and amplitudes of a high frequency amplitude loop and a low frequency amplitude loop respectively;

selecting a corresponding background color of the LEDs based on the frequency of the high frequency loop, selecting a corresponding foreground color of the LEDs based on the frequency of the low frequency loop, adjusting a background brightness of the LEDs based on the frequency of the high frequency amplitude, and adjusting a foreground brightness of the LEDs based on the frequency of the low frequency amplitude; and displaying based on the display function parameters prior to returning.

20. The method of claim 14, wherein the full color LED based lighting apparatus operated in synchronism with music comprises an audio frequency band-pass filter, a high frequency band-pass amplification circuit, a first level comparator, a low frequency band-pass amplification circuit, a second level comparator, an intermediate frequency band-pass amplification circuit, a third level comparator, a first amplitude detection circuit, an ADC, an integration circuit, a microcontroller, and an LED drive circuit, and a seventh subroutine with respect to a triple loop frequency and a single loop amplitude comprises the steps of:

reading out frequencies of a high frequency loop, an intermediate frequency loop, and a low frequency loop, and an amplitude of an amplitude loop from the integration circuit selecting a corresponding red LED based on the frequency of the low frequency loop, selecting a corresponding green LED based on the frequency of the intermediate frequency loop, selecting a corresponding blue LED based on the frequency of the high frequency loop, and adjusting LED brightness based on the amplitude of the amplitude loop; and displaying based on the display function parameters prior to returning.

21. The method of claim 14, wherein the full color LED based lighting apparatus operated in synchronism with music comprises an audio frequency band-pass filter, a high frequency band-pass amplification circuit, a first level comparator, a low frequency band-pass amplification circuit, a second level comparator, an intermediate frequency band-pass amplification circuit, a third level comparator, a second amplitude detection circuit, a first ADC, a third amplitude detection circuit, a second ADC, a fourth amplitude detection circuit, a third ADC, an integration circuit, a microcontroller, and an LED drive circuit, and an eighth subroutine with respect to a triple loop frequency and triple loop amplitude comprises the steps of:

reading out frequencies of a high frequency loop, an intermediate frequency loop, and a low frequency loop, and amplitudes of a high frequency amplitude loop, an intermediate frequency amplitude loop, and a low frequency amplitude loop from the integration circuit;

selecting a corresponding red LED based on the frequency of the low frequency loop, selecting a corresponding green LED based on the frequency of the intermediate frequency loop, selecting a corresponding blue LED based on the frequency of the high frequency loop, adjusting brightness of the red LED based on the low frequency amplitude, adjusting brightness of the green LED based on the intermediate frequency amplitude, and adjusting brightness of the blue LED based on the high frequency amplitude; and displaying based on the display function parameters prior to returning.

* * * * *